US011927424B2

(12) United States Patent
Nebergall et al.

(10) Patent No.: US 11,927,424 B2
(45) **Date of Patent: *Mar. 12, 2024**

(54) FIRING SYSTEM FOR A CROSSBOW

(71) Applicant: Alan Products LLC, Sanford, FL (US)

(72) Inventors: Dirk Nebergall, Sanford, FL (US); Bahram Khoshnood, Alpharetta, GA (US)

(73) Assignee: Alan Products LLC, Sanford, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/984,343

(22) Filed: Nov. 10, 2022

(65) Prior Publication Data

US 2023/0071626 A1 Mar. 9, 2023

Related U.S. Application Data

(63) Continuation of application No. 17/552,017, filed on Dec. 15, 2021, now Pat. No. 11,525,650.
(Continued)

(51) Int. Cl.
*F41B 5/12* (2006.01)
*F41B 5/00* (2006.01)
*F41B 5/10* (2006.01)

(52) U.S. Cl.
CPC ..... *F41B 5/123* (2013.01); *F41B 5/0094* (2013.01); *F41B 5/105* (2013.01)

(58) Field of Classification Search
CPC ..... F41B 5/0094; F41B 5/12; F41B 5/123
See application file for complete search history.

(56) References Cited

U.S. PATENT DOCUMENTS 2,714,377 A 8/1955 Mulkey
3,028,851 A 4/1962 Drake
(Continued)

*Primary Examiner* — John A Ricci
(74) *Attorney, Agent, or Firm* — Rankin, Hill & Clark LLP

(57) ABSTRACT

A firing system for a crossbow having an arrow rest extending along an arrow rest axis, the firing system having a right limb and a left limb, the right limb being pivotable about a right limb axis and the left limb being pivotable about a left limb axis, the firing system further including a right cam and a left cam, the right cam having a right bow string groove and being rotatable about a right cam axis, the left cam having a left bow string groove and being rotatable about a left cam axis, the firing system having a bow string extending between the right and left cams and extending within the right and left bow string grooves, the bow string positionable between an un-cocked condition and a cocked or full draw condition wherein movement of the bow string from the un-cocked condition toward the cocked condition moves the right and left cams toward each other and pivots the right and left limbs about the right and left limbs axes respectively, the firing system further including a power assembly having a power cable and a spring assembly, the power cable having a forward end operably joined to the right and left limbs and a rear end operably joined to the spring assembly, the spring assembly having a power spring extending along a power spring axis between a first spring end and a second spring end and having a central spring opening, the power spring being below the arrow rest, the power cable extending through the central spring opening from the first spring end toward the second spring end, the rear end of the power cable being operably joined relative to the second spring end of the power spring, moving the bow string from the un-cocked condition to the cocked condition causing the right and left limbs to the pull forward end of the power cable forwardly wherein the operable engagement with the
(Continued)

second spring end compressing the power spring by pulling the second spring end toward the first spring end to produce the shooting force to propel the archery arrow.

16 Claims, 19 Drawing Sheets

Related U.S. Application Data

(60) Provisional application No. 63/127,266, filed on Dec. 18, 2020.

(56) References Cited

U.S. PATENT DOCUMENTS

| | | | | |
|---|---|---|---|---|
| 4,169,456 | A | 10/1979 | Van House | |
| 4,388,914 | A | 6/1983 | Cesin | |
| 4,458,657 | A | 7/1984 | Stockmar | |
| 4,756,295 | A | 7/1988 | Guzzetta | |
| 6,055,974 | A | 5/2000 | Dieziger | |
| D428,912 | S | 8/2000 | Bolle | |
| 6,273,078 | B1 | 8/2001 | Schwesinger | |
| 6,698,413 | B1 | 3/2004 | Ecklund | |
| 7,201,161 | B1 | 4/2007 | York | |
| 8,485,170 | B1 | 7/2013 | Prior | |
| 8,522,763 | B2 | 9/2013 | Nebergall | |
| 8,789,519 | B2 | 7/2014 | Nebergall | |
| 8,789,520 | B2 | 7/2014 | Nebergall | |
| 9,341,431 | B2 | 5/2016 | Nebergall | |
| 9,574,841 | B2 | 2/2017 | Nebergall | |
| 9,719,749 | B1 | 8/2017 | Prior | |
| 11,525,650 | B1 * | 12/2022 | Nebergall | F41B 5/123 |
| 2010/0000504 | A1 | 1/2010 | Trpkovski | |
| 2014/0069400 | A1 | 3/2014 | Nebergall | |
| 2019/0025004 | A1 | 1/2019 | Thalberg | |
| 2020/0408481 | A1 | 12/2020 | Chang | |

* cited by examiner

FIRING SYSTEM FOR A CROSSBOW

This application claims priority in Non-Provisional patent application Ser. No. 17/55,2017 filed on Dec. 15, 2021, which claims priority in Provisional Patent Application No. 63/127,266 filed on Dec. 18, 2020 which are both incorporated by reference herein.

The present invention relates to crossbows. And, more particularly, the invention of this application relates to a firing system for crossbows wherein the firing system has an improved spring loaded system that increases arrow speeds, improves the overall balance of the crossbow, balances the forces produced by the crossbow, improves reliability and that reduces the overall size of the crossbow and reduces the noise produced by the crossbow.

INCORPORATION BY REFERENCE

U.S. Pat. Nos. 8,522,763, 8,789,519, 8,789,520, 9,341,431, 9,574,841 to Nebergall are all incorporated by reference into this specification as background material. Also incorporated by reference into this specification as background material are D. M. Holmes U.S. Pat. Nos. 428,912, 4,458,657 to Stockmar, U.S. Pat. No. 7,201,161 to York, U.S. Pat. No. 6,055,974 to Dieziger, U.S. Pat. No. 2,714,377 to Mulkey, U.S. Pat. No. 4,756,295 to Guzzetta, and U.S. Pat. No. 6,698,413 to Eklund. All of these patents are incorporated by reference into this application and form part of the specification of this application.

BACKGROUND OF THE INVENTION

The traditional archery bow is comprised of a riser having a hand grip and an arrow rest and a pair of resilient limbs attached to each end of the riser. The resilient limbs of the bow flex to produce a stored energy needed to propel an archery arrow. The bow string is attached to the free end of each resilient limb so that when the bow string is drawn back from its initial position by an archer to shoot an arrow, the resilient limbs flex to place the bow string under tension. The further the archer draws the bow string back, the more the resilient limbs of the bow are flexed which imparts a greater amount of stored energy in the bow. When the bow string is released to shoot the arrow, the resilient limbs of the bow snap back to their original position to force the bow string back to its initial position to propel the archery arrow towards a target. These traditional bows are frequently made of strong composite materials but they do have drawbacks. For instance, once an archer selects a particular archery bow, he is restricted with that bow to a maximum drawing force so that the archer is unable to vary the poundage range for a particular bow. Yet other drawbacks include the holding forces relating to these types of bows; especially when in the full drawn position. In this respect, the stored energy of a traditional bow increases as the bow string is drawn back. Similarly, the holding forces increase as the bow string is drawn back such that the maximum stored energy is generally coupled with the maximum hold force when the bow is in the full drawn position. In that this is the firing position for the bow, the shooter exerts considerable energy in holding the bow in the full drawn position to take aim at the desired target. When using a bow for hunting, this can be very difficult and can cause shots to be rushed and/or off target. Further, this condition limits the amount of stored energy that can be utilized in a traditional bow in that high levels of stored energy produce high holding forces that cannot be overcome by the shooter. Therefore, the traditional bow has limits to its ability to utilize and manage high levels of stored energy. Yet even further, not only is it difficult or impossible to modify the traditional long bow, special equipment is needed to remove the bow string from the bow limbs in that they must be pre-stressed in order to produce the necessary stored energy. While, in some cases, the bow string could be removable, it is difficult and requires a lot of strength.

While traditional bows utilize the limbs to produce stored energy, some prior art bows have attempted to use springs for loading the bow that have not had any real success. An earlier spring loaded archery bow can be seen in the D. M. Holmes U.S. Pat. No. 428,912 which includes a tension spring extending through the riser of the bow. As can be seen, this drastically limits the configuration of the riser which has been found to be an integral part of a bow design. As with many hand operated tools, ergonomics are very important and this spring design adversely affects the riser's ergonomics significantly. Yet even further, the use of a tension spring also greatly increases the objectionable sound that is produced by the system. As can be appreciated, when this spring snaps back to its at rest position, it will wobble and produce noise that is not acceptable when hunting. Yet even further, this spring wobble could likely be felt in riser by the archer which is also not acceptable and which could affect accuracy. Further, the Holmes bow cannot be modified and the stored energy and hold force will be at its highest level at the full draw point just like a traditional bow. Thus, while this bow may be capable of producing higher amounts of stored energy, it is very similar to a traditional bow and does not allow for the management of those higher energy levels. This design is also not adjustable and requires a custom spring that has opposing extensions for connecting the spring to the limbs.

Similarly, U.S. Pat. No. 4,458,657 to Stockmar discloses an archery bow that does not utilized flexible limbs, Stockmar discloses a complicated bow structure with both a main frame and a separate handle grip space forwardly of the frame wherein the bow string tensioning assembly is located forward of the main frame. The bow string tensioning assembly is formed by exposed resilient tubes for tensioning the bow string which are stretched and placed in tension when the bow string of the bow is drawn. By including both a riser and a solid frame, this design drastically increases the weight of the bow. As can be seen, Stockmar recognized this problem by including weight reducing holes in his frame design. Yet further, this design has exposed workings that could be dangerous and which would be drastically impacted by weather changes. As is now, resilient materials, such as those disclosed, will produce greatly different amounts of stored energy in cold weather than in warm weather. Further, by including significant frame and riser designs, this system will create significant blind spots which is especially problematic when quick target acquisition is needed; such as when the bow is used for hunting. The frame design behind the handle grip or riser also creates a design flaw wherein the archer's arm would likely engage this frame structure when firing the bow.

A compound archery bow uses mechanical advantage to overcome many of the shortcomings of the traditional bow and the spring loaded bows that simulate traditional bows to allow for increases in stored energy while managing the holding forces when in the full drawn position. This is typically accomplished by utilizing cams and/or pulleys attached to the limbs of the bow. Again, the limbs act to store energy and can be designed to store greater amounts of energy wherein the limbs of a compound bow are usually much different than those of a traditional archery bow. Further, the cams of a compound bow can be utilized to both increase the stored energy and reduce the hold force when the bow is in the full drawn position which allows the compound bow to direct much greater amounts of energy into the arrow. In that the compound bow attaches the bow string to cams or pulleys to give a mechanical advantage to the bow string, when the bow string is pulled, it causes the cams to rotate and the limbs to bend. Again, the limbs provide the stored energy, but the cams provide mechanical advantage to increase the stored energy and to decrease the hold force in the full drawn position. However, while the hold force may be lower for the full drawn position, it is typically higher before the full drawn position is reached. A compound bow has a rigid handgrip or riser having limbs attached to each end and having the sights and the like attached thereto.

Even though compound bows have overcome many shortcomings in the traditional bow, it also has many limitations; one such limitation is that it is not easily adjustable. As with the traditional bow, the compound bow relies on the stored energy of the flexible limbs which cannot be changed. These flexible limbs are built into the compound bow and cannot be adjusted or modified once the bow is manufactured. However, it has been found that the cams can be utilized to change the dynamics of the compound bow wherein the overall stored energy of the system can be modified by changing the cam configuration. Further, other dynamics can be modified by changing the cams of the bow. However, while the use of rotating cams allows for modifications, these cannot be done easily and typically require expensive equipment that must be used to overcome the high levels of stored energy in the flexible limbs. In this respect, an archer who wants to modify their bow must take their bow to an archery dealer who has the equipment to compress the limbs of the bow sufficiently to loosen the bow string and remove the cam or cams without damaging the flexible limbs that can be very fragile. The same is true for repairs to damaged bows. These cannot be done without specialized equipment. Thus, if a bow is damaged in the field (such as while on a hunting trip), the hunter cannot fix his damaged bow and typically caries a spare bow just for this situation. Even if the hunter did own the necessary equipment, it is not practical to take the needed equipment into the field. Thus, while the compound bows allow for the use and management of higher levels of stored energy, that is essentially the extent of the benefit of these bows. In addition, it has been found that the flexible limbs used in compound bows can fail over time and this is being made worse by the ever increasing amounts of pre-load tension that is being put into these flexible limbs when the bows are strung. This is especially true with crossbows wherein crossbow limbs are being preloaded with such high tension for arrow speed that the limbs often break.

In the York U.S. Pat. No. 7,201,161, disclosed is another spring loaded archery bow that also incorporates a spring in the riser portion of the bow. York discloses a riser that has separate upper and lower spring tensioning assemblies and these assemblies both include a central tension cable that extends within a coil spring to join opposing swoosh shaped cam members. Further, separate upper and lower spring tensioning assemblies are contained within the upper and lower rigid limbs of the bow so that the bow retains the appearance of a traditional archery bow. By include two separate spring and cable assemblies, this arrangement increases weight. Moreover, the increased weight is at the forward most position when it is being held by the user thereby creating a balance issue when in use. Carry the weight at the forward most position of an object being held by a user is not ideal. In the Dieziger U.S. Pat. No. 6,055,974 a compound bow has a facilitated draw for allowing a bow string to be more easily drawn and uses a pair of complicated and fragile coil springs string structures that are fully exposed. Further, as with other spring bow systems, while springs are disclosed, these systems do not include structure that can be easily modified for the many archers that may use a single bow. In the L. J. Mulkey U.S. Pat. No. 2,714,377, discloses a complicated spring structure system that surrounds the riser of the bow and which is fully exposed even though it is in close proximity to the archers hands and arms. Similarly, the Guzzetta U.S. Pat. No. 4,756,295 discloses a complicated bow structure that includes linkages extending about the riser of the bow and which are again fully exposed. While the toggle-like assembly may be configured to improve the accuracy and acceleration of the bow, it utilizes a single coil spring and requires many components that would add weight and complexity to the system. Moreover, the added weight is at the forward most extent of the bow wherein the balance of this bow is poor.

Eklund U.S. Pat. No. 6,698,413 discloses an archery bow includes a solid and rigid frame having no flexing or pivoting components. Conversely, Eklund discloses a bow that uses a rotating wheel to create the necessary stored energy to shoot an arrow. This system includes a lower wheel rotatably mounted to the lower limb that rotatably attached to a self-contained tensioning unit having a variably compressible power coil spring therein. A cam is rotatably mounted to the lower limb between the lower wheel and the tensioning unit and is engaged by a cable which connects the spring with the lower wheel so as to provide a resilient pull to establish a draw weight required to move the bowstring from an at-rest position to a drawn position. While Eklund disclose adjustment to the pull length, this bow system is also not easily modifiable and is significantly out of balance. As can be seen, the vast majority of the bow weight is located on one side of his bow which greatly reduces the ability to aim this bow. Moreover, the added weight is at the forward most extent of the bow wherein the balance of this bow is poor.

The Nebergall U.S. Pat. Nos. 8,522,763, 8,789,519, 8,789,520, 9,341,431, 9,574,841 overcame many of the problems in the art by utilizing a firing system having a spring assembly, a generally L-shaped crank and a rotatable cam. The spring assembly having a spring housing with a rearwardly facing opening and an inner passage extending inwardly from the rearward opening. The spring assembly further including a compression spring extending in the inner passage and having a spring end cap at a first end facing the rearward opening. The L-shaped crank having a first leg and a second leg extending from a common pivot portion and the crank being rotatable about a crank axis in the pivot portion and the crank axis being generally fixed relative to a central frame structure of the bow, the first leg having an engaging surface spaced from the central axis configured to engage the end cap of the compression spring when the crank is rotated about the crank axis, but which is not connected thereto. The second leg having a pivot joint spaced from the crank axis configured to support the rotatable cam thereby allowing the cam to rotate about a cam axis spaced from the central axis. The cam having an outwardly facing cam shaped guide groove configured to support and guide a bow string about the rotatable cam as it is rotated about the cam axis. The firing system providing stored energy to shoot an archery arrow in that when the bow string is pulled back for shooting the associated arrow, both the cam rotates about the cam axis and the crank rotates about the crank axis wherein the crank compresses the compression spring to provide an amount of stored energy to propel the arrow and the cam provides at least one of increasing the amount of stored energy and reducing a holding force for the shooter when the bow is at full draw. In addition, it has been found that this bow system is not only more effective that prior art designs, but it is even quieter that traditional compound bows that do not utilize springs in that the flexible limbs even create noise when that snap back to their at rest position.

Moreover, the Nebergall firing system that pushes on a firing spring to compress the spring is also well suited for use on crossbows. However, the Nebergall system that pushes on the firing spring causes the spring to be positioned forwardly in the crossbow frame wherein the balance of the crossbow was not ideal.

Again, while there are many bow designs, there remains a need for an effective archery bow that is lightweight, reliable, and fully adjustable without needing to take the bow to an archery shop. Further, this crossbow needs to be capable of producing high shooting speeds, but with low holding forces at full draw. Moreover, there is a need for such as design that can be effectively used in a crossbow. While many of the bows discussed above have some of these features, none have all and many are deficient in many ways. Thus, many of these designs have never been produced.

SUMMARY OF THE INVENTION

The present invention relates to a firing system for an archery bow and especially relates to an improved spring loaded archery bow systems wherein the spring provides the stored energy to shoot an archery arrow. While spring energy has been used in the past, the invention of this application uses a firing system that has a new limb configuration and a new power cable configuration that pulls on the power spring to create the stored energy to propel the archery arrow. The combination of the limb design and the use of a tension power cable provide greatly improved shooting speeds, a quieter firing system and a firing system that produces a more balanced crossbow.

Moreover, it can provide all of this with a more compact and balanced design. As is known in the art, the users of bows often have to hold the bow in a firing position for extending periods to align a shot and take the shot. By having a bow that is better balanced, the fatigue associated with holding the bow in a shooting position is significantly reduced.

More particularly, the firing system of this application includes a spring assembly positioned rearwardly of the bow limbs wherein the power cable pulls on the power spring.

The firing system according to certain aspects of the invention of this application includes a power spring that is parallel to the arrow rest or bolt track.

The firing system according to other aspects of the invention of this application includes a power spring that is parallel and below the arrow rest or bolt track.

The firing system according to yet other aspects of the invention of this application includes a reversing pulley that re-directs the power cable 180 degrees to allow the power cable to pull the power spring rearwardly. This rearward pull of the power spring moves the center of gravity even further rearwardly when the cross bow is in the full draw or cocked condition.

The firing system according to yet further aspects of the invention of this application includes limbs that pivot rearwardly toward the arrow rest or bolt track, which further balances the crossbow when in the cocked condition.

The firing system according to even yet further aspects of the invention of this application includes cams joined to the limbs wherein the bow string extends from the front side of the cams and across the arrow rest as the limbs pivot rearwardly toward the arrow rest.

These limbs can be a single limb arm design or a multi-component limb assembly having both an upper and a lower component wherein the cams are sandwiched between them.

The firing system is configured to include a power cable that pulls on a power spring wherein this configuration allows for spring placement that better balances the crossbow. This include, but is not limited to, moving the bow spring rearwardly in the crossbow. Moreover, it has been found that the modified spring placement of invention makes the crossbow extremely compact and more balanced.

In one set of embodiments, the mass weight of the spring(s) can be forward of the trigger assembly and in the foregrip of the stock below the arrow rest.

According to further aspects of the invention, the firing system can include a power cable with a power cable splitter wherein the power cable includes power cable right and left extensions that are directed to the right and left limb assemblies, respectively, wherein a single spring assembly and a single power cable assembly can operate both limbs. The single power cable is therefore operably attached to both limbs to generate the shooting force.

According to yet further aspects of the invention, the firing system can include one or more re-directing pullies. These re-directing pullies can include a lowering pulley arrangement to re-direct the power cable lower within the crossbow receiver. This can include, but is not limited to, a two-pulley lowering pulley arrangement to allow the power spring to be positioned below the bolt track or arrow rest. As can be appreciated, stacking the arrow rest and spring assembly can reduce size, reduce weight and produce a better center of gravity. Moreover, these spring arrangements of the firing system can be configured to have a spring axis that is parallel with the arrow rest. By have a parallel spring assembly, shooting forces align with the direction of the arrow.

According to yet other aspects of the invention, the firing system can include a power cable having extensions that are joined near a forward end of the limbs, where the cams are rotatably joined at cam axes near rearward ends of the limbs and where the limbs are pivotably joined to the riser at a pivot point between the forward end and the cam axis.

According to even yet other aspects of the invention, the limbs are attached pivotally at a pivot point that is approximately at the arm assembly centers, but this can be adjusted for changes in performance. Again, the connection of the limb to the power cable is at a power connection point that can be at or near a forward end of each limb assembly. The cams/wheels are mounted to a rearward end of the limbs on the other side of the pivot point as the power connection point. The cams/wheels rotate about a cam/wheel axis and can include a wide range of features known in the art and new features that will be known in the art. As is known, the bow string is attached to the cams/wheels. The cams/wheels can also be anchored with take-up cables or timing cables. Moreover, the bow string can extend from the front side of the cams.

According to another set of embodiments, the power cable end can be arraigned in such a way that it is adjustable. This can include the use of one or more threaded fasteners. In this arrangement, the user can release the tension on the cable to facilitate the removal or replacement of the worn or damaged string/cables and/or customize the bow.

According to another set of embodiments, the cams can be cam assemblies that include timing cam spacers to space the timing cables from the bow string. Moreover, the timing cable spacer can align the timing cables with an opening in the crossbow stock below the arrow rest. By spacing the timing cable from the bow string and aligning them with an opening in the crossbow stock, the timing cables can freely move without creating wear points or rub points with other components of the crossbow.

According to even further aspects of the invention, the firing system can include a wide range of adjustment features. As noted above, there can be an adjustment feature and/or disassembly feature associated with the connection between the power cable and the spring of the assembly. This can be used to disengage the spring to allow the end user to work on the bow. However, it can also be used to adjust the forces generated by the spring. This can include adjustment to change the arrow speed. As can be appreciated, different arrow speeds can be desired and/or required depending on the use of the bow. This adjustment feature can also include one or more scales that can be used to gauge the changes to the shooting forces and/or to mark desired shooting forces and/or a range thereof.

According to other aspects of the invention, the firing system can also include a wide range of spring designs and/or replaceable spring and/or exchangeable springs. This feature can also allow for changes to shooting forces, such as change the bow from an adult bow to a kids bow. Moreover, even though a single spring is shown, more than one spring can be used and the more than one springs can include different spring rates. As with the adjustments noted above, different springs can be used to change the shooting speeds and/or forces of the bow.

According to yet other aspects of the invention, the power cable can extend through the center of the spring and wherein the spring axis and the arrow axis are parallel. This has been found to improve balance, lower weight, reduce sound and create a more compact firing system. This can include a pass through power cable that is attached to the back side of the spring wherein the spring can be pulled forward as the bow string is drawn toward the cocked condition. However, the firing system can further include a reversing pulley that re-directs the power cable 180 degrees to allow the power cable to pull the power spring rearwardly. This arrangement has been found to move the center of gravity even further rearwardly when the cross bow is in the full draw or cocked condition. Moreover, the firing system can include a sleeve arrangement that can engage an end of the spring and encircle the spring. The power cable can then be connected relative to the sleeve. In certain embodiments, this crossbow can include a spring assembly that is housed within a fore grip of the cross bow.

Yet even further, the firing system of this application that utilizes tension in the power cable allows the position of the power spring to be modified based on any desired performance parameters. It has been found that one such benefit is that the spring can be located to improve the balance of the bow. This can include, but is not limited to, moving the center of gravity of the bow rearwardly and closer to the body of the user. According to certain embodiments, the invention can include an adjustable spring mounting system. As can be appreciated, the pulling of the spring rearwardly can mean that the rear of the spring is stationary. This stationary support of the spring can be located as desired in the bow. Moreover, the spring can be aligned as desired. In the embodiments shown, the spring shown is in axial alignment with the arrow rest and the stock of the bow, which further aligns the forces with the direction of the arrow. However, this is not required. Moreover, the support for the spring can be adjustable. This can be used to adjust the location of the spring relative to the stock to allow the end user to fully customize both the shooting speeds and the balance of the bow by creating an adjustable center of gravity.

Essentially, the spring can be virtually anywhere in the bow wherein the power cable just needs to be directed to the location of the spring. Accordingly, the spring could even be located in the butt of the crossbow. The options are endless It should be clear at this time that a tensioned power cable spring loaded archery bow has been provided which advantageously can be adjusted for individual archers both in terms of the adjusting the force required to pull the bow string and adjusting the balance point of the bow. However, the present invention is not to be construed as limited to the forms shown which are to be considered illustrative rather than restrictive.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
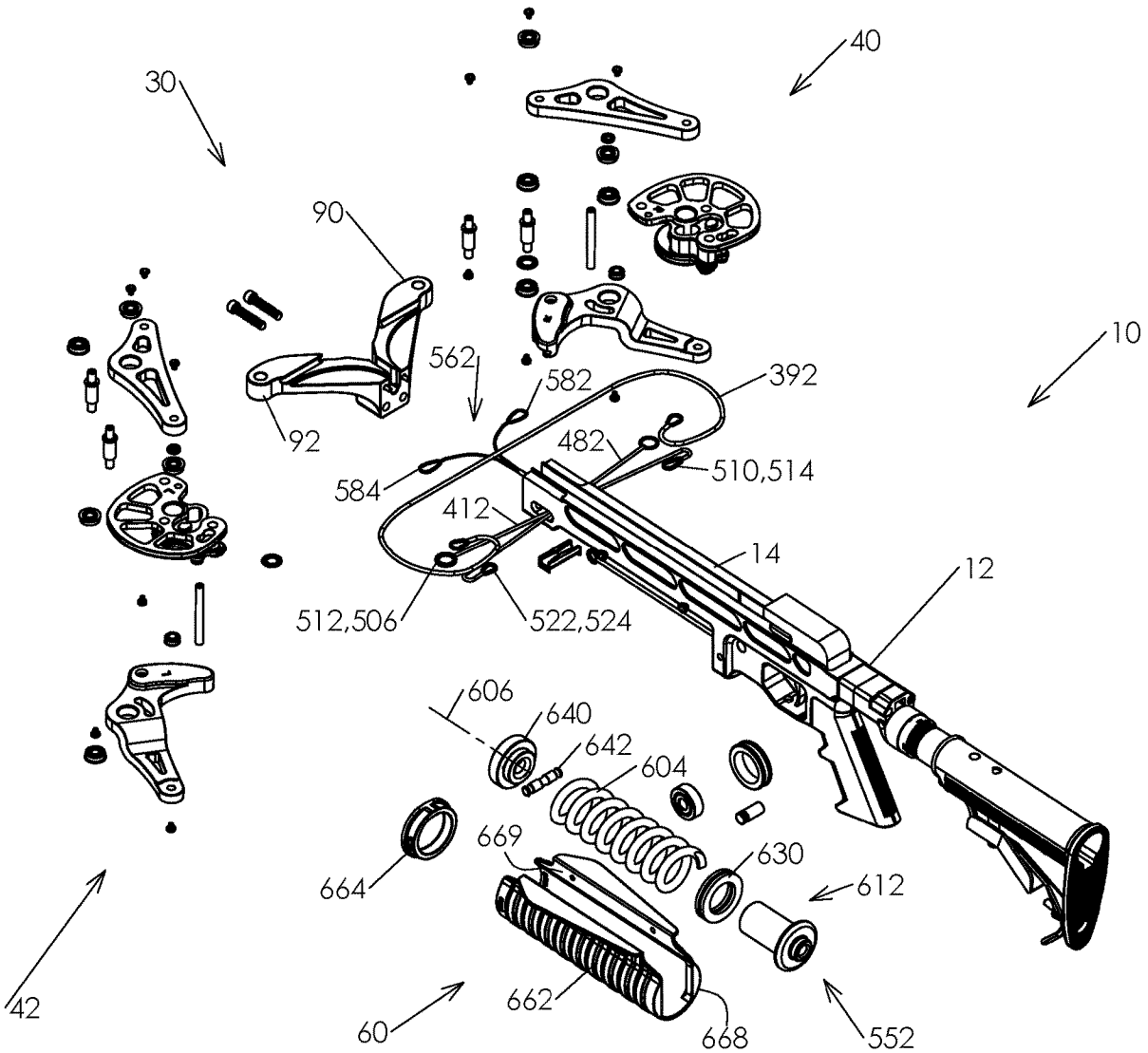
FIG. 1 is an exploded perspective view of a crossbow according to certain aspects of the present invention.
Figure 2:
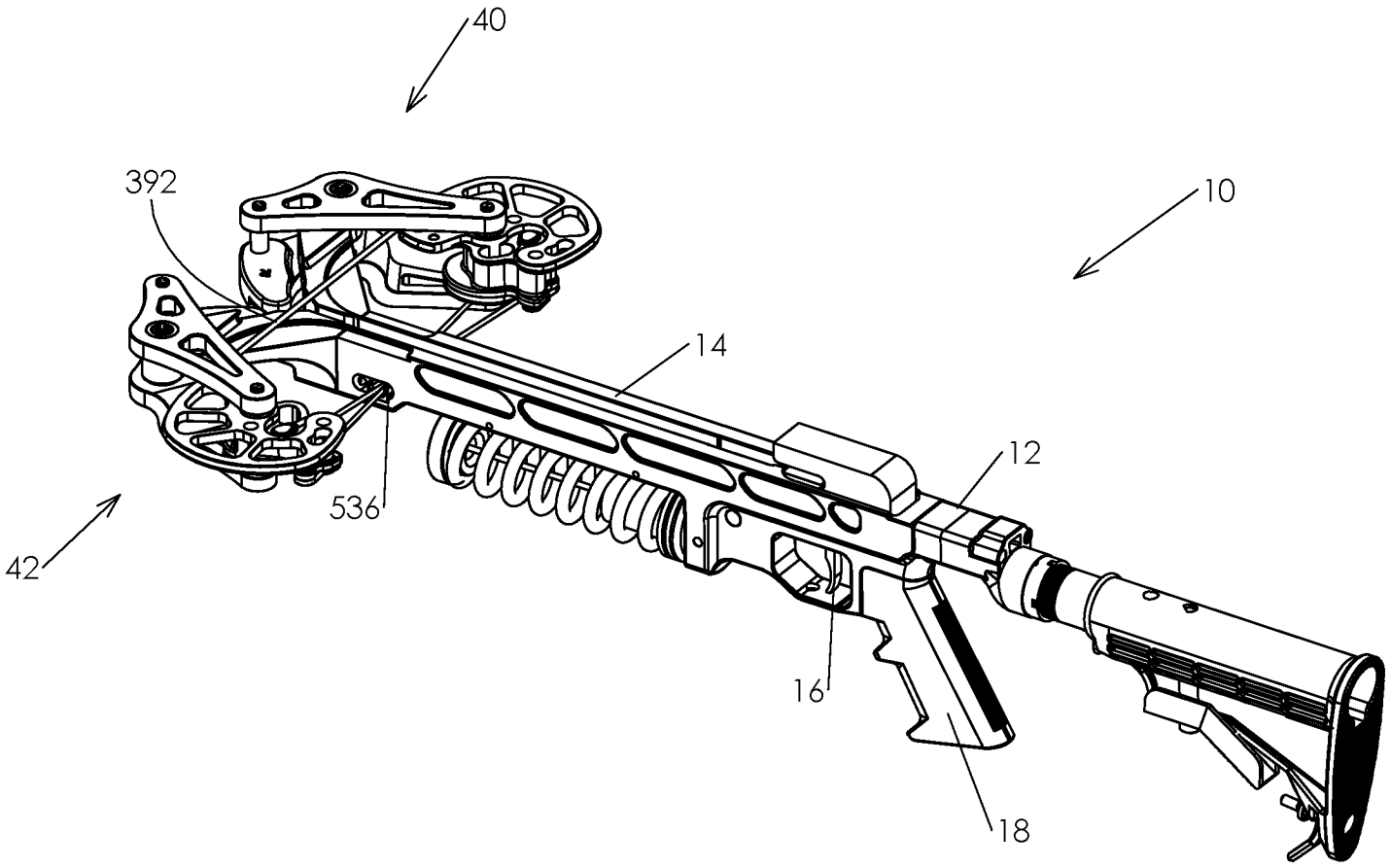
FIG. 2 is a perspective view of the crossbow shown in FIG. 1 in an assembled condition with the foregrip removed and shown in an un-cocked position.
Figure 3:
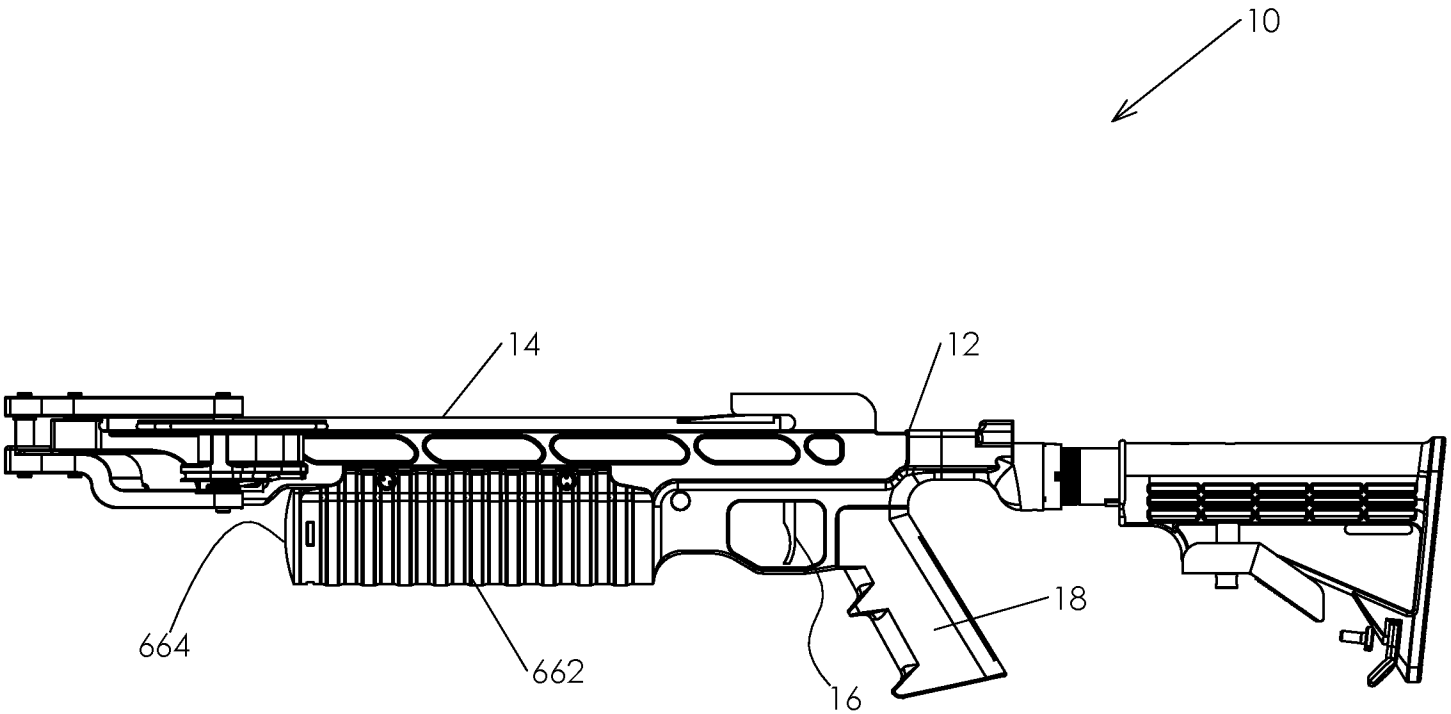
FIG. 3 is a left side view of the crossbow shown in FIG. 2 with the foregrip.
Figure 4:
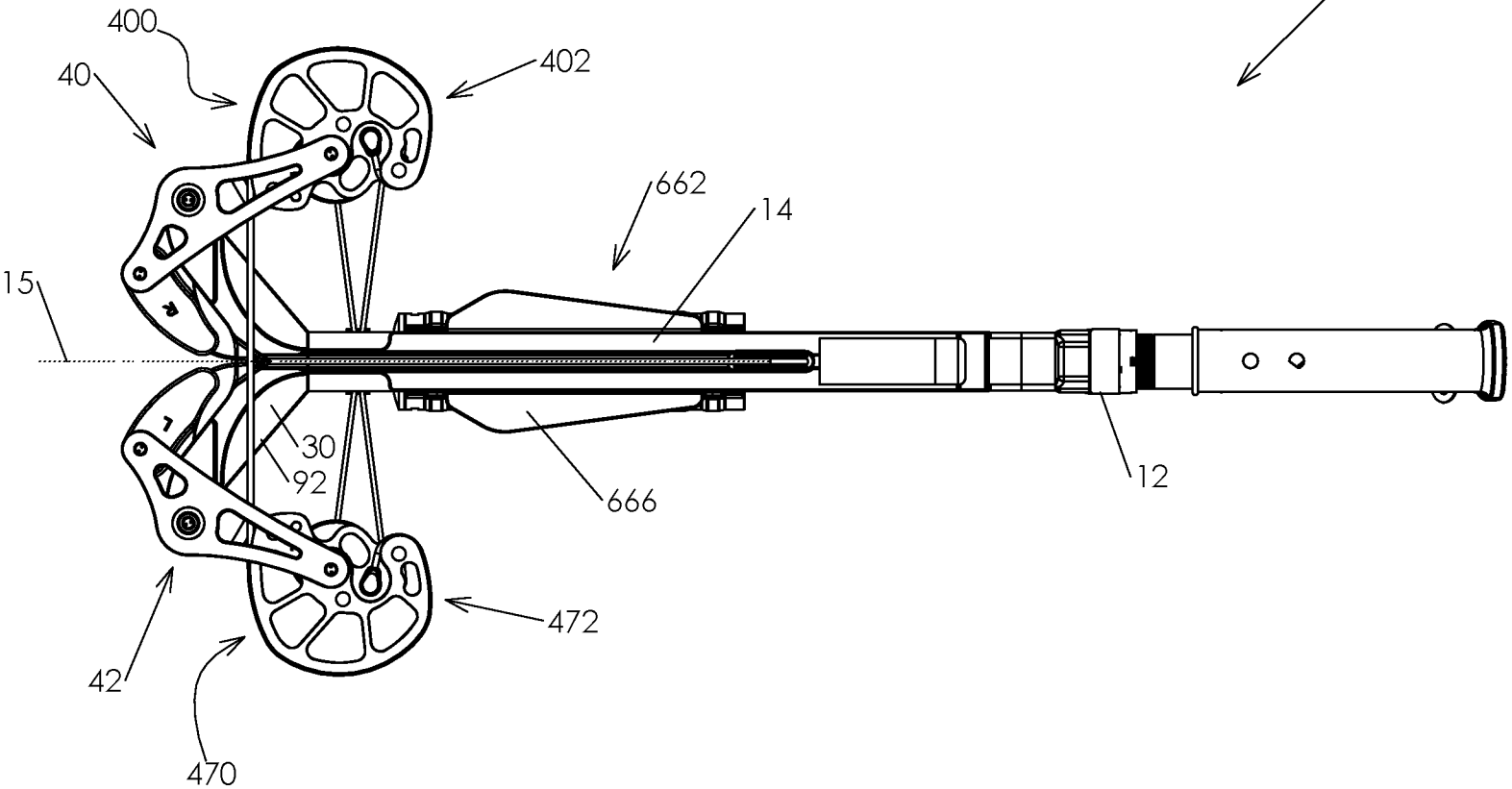
FIG. 4 is a top view of the crossbow shown in FIG. 3 in the un-cocked condition.
Figure 5:
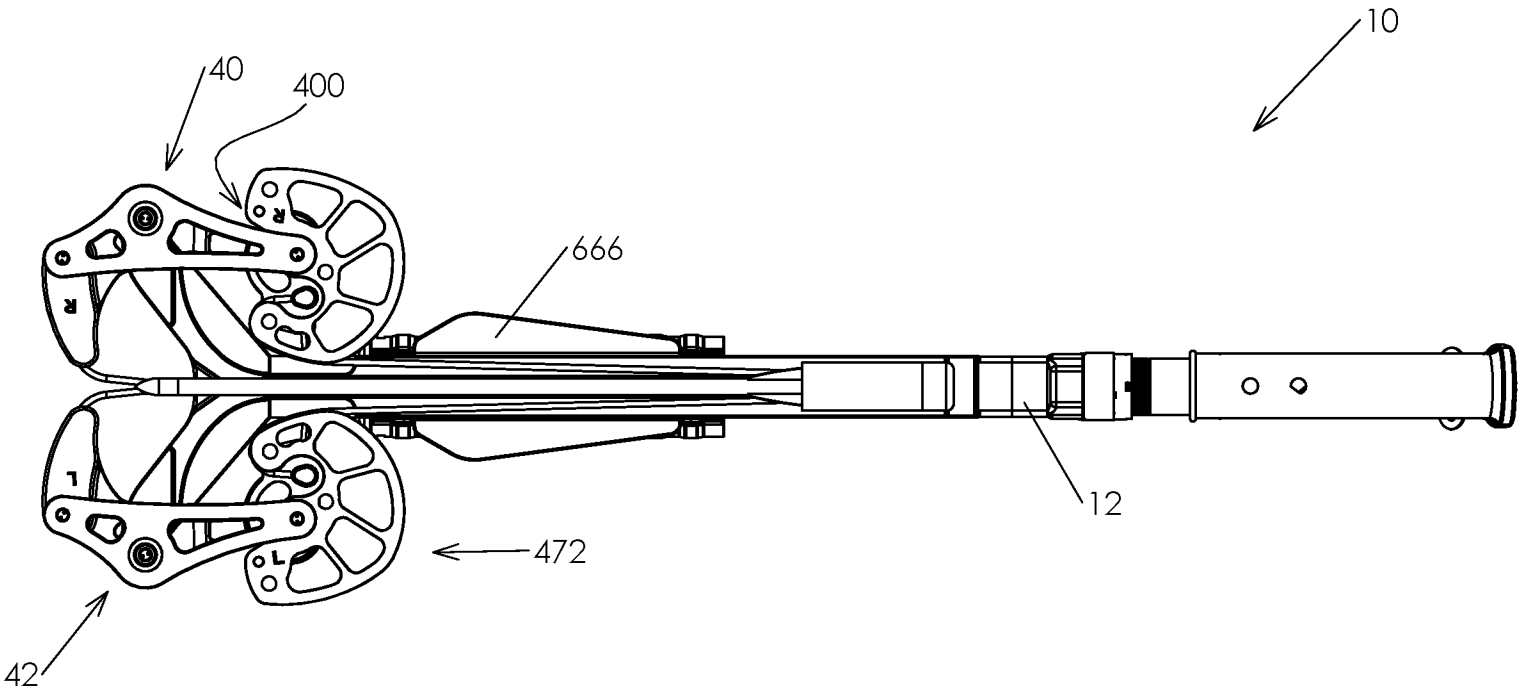
FIG. 5 is a top view of the crossbow shown in FIG. 3 in the cocked or full drawn condition.
Figure 6:
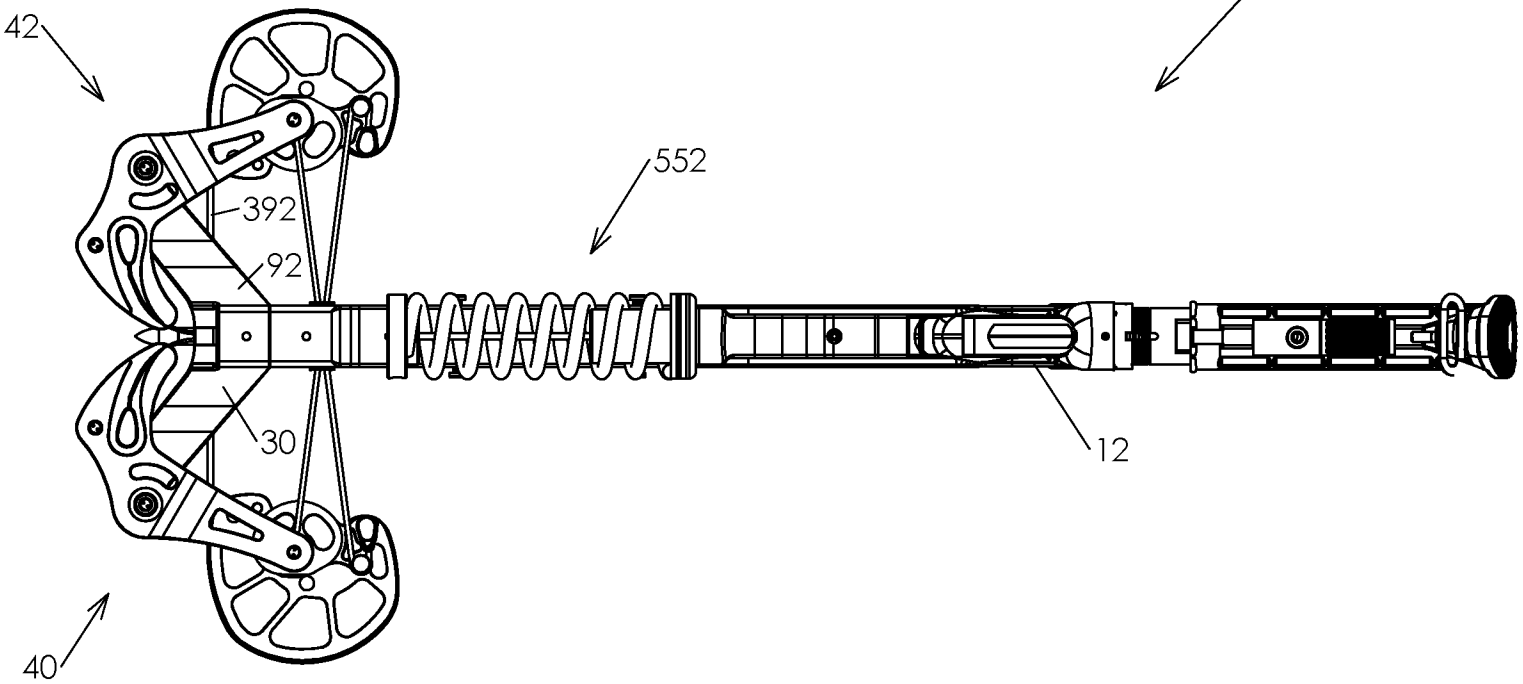
FIG. 6 is a bottom view of the crossbow shown in FIG. 2 in the un-cocked condition.
Figure 7:
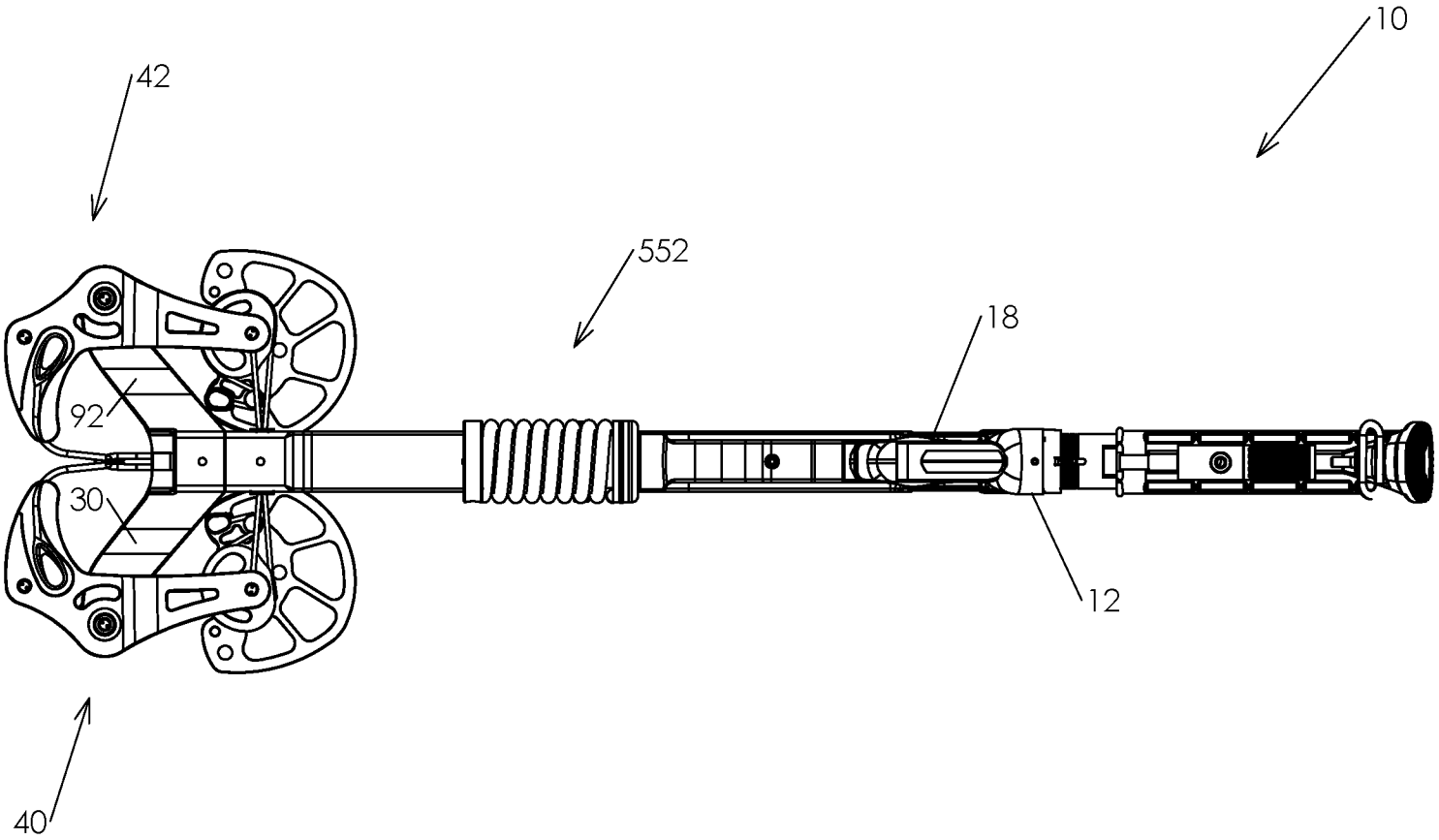
FIG. 7 is a bottom view of the crossbow shown in FIG. 2 in the un-cocked condition.
Figure 8:
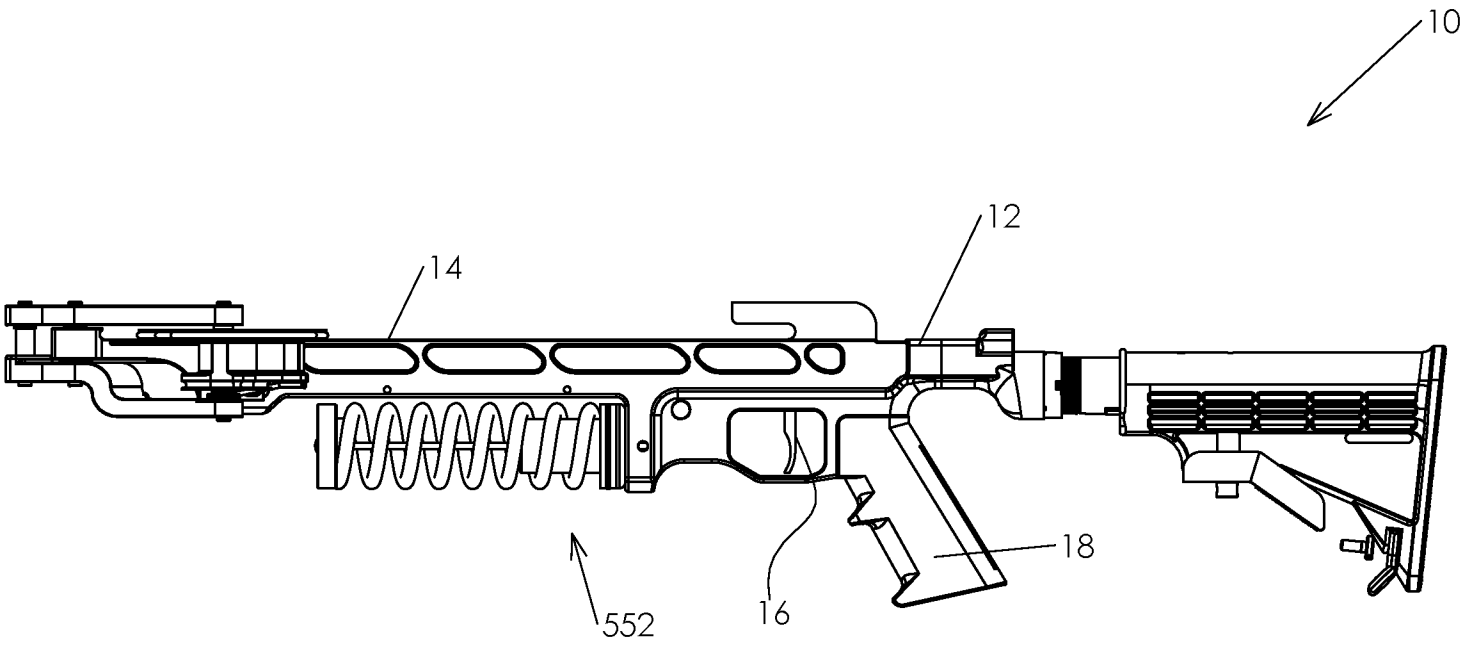
FIG. 8 is a left side view of the crossbow shown in FIG. 2 in the un-cocked condition.
Figure 9:
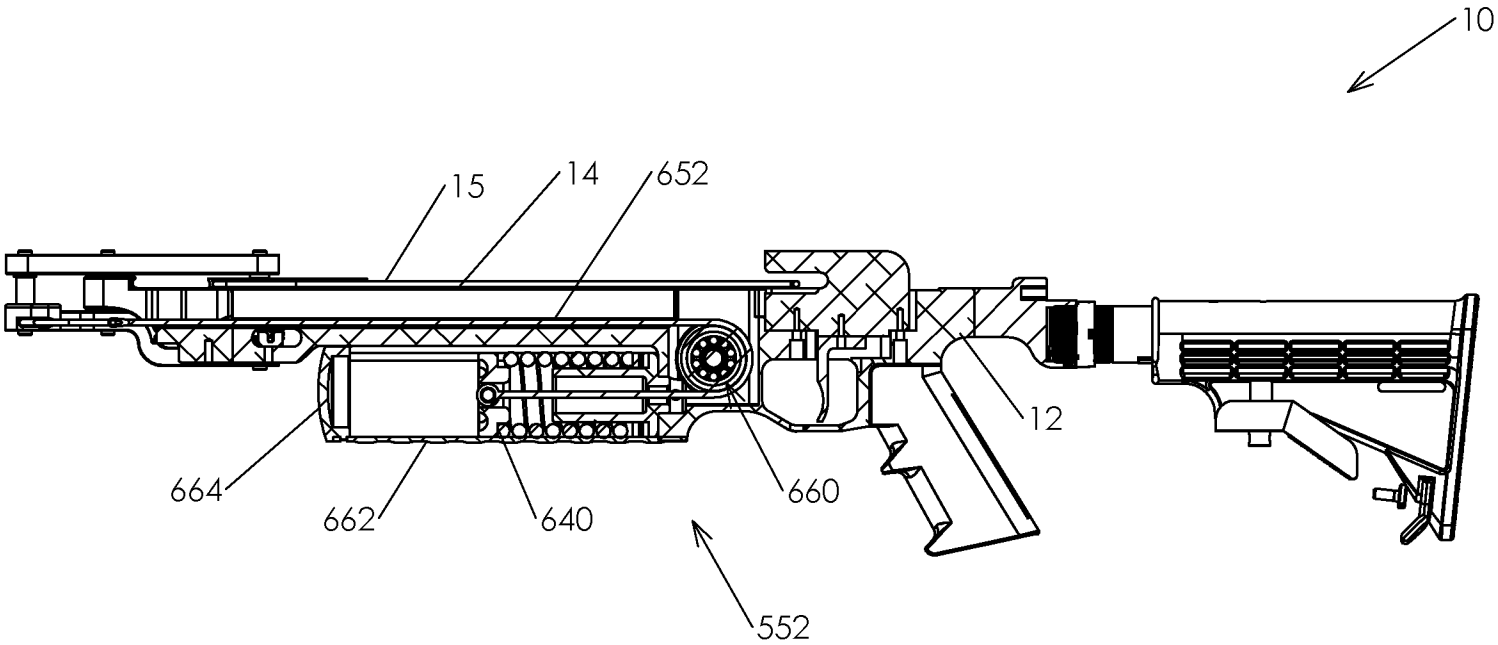
FIG. 9 is a partial sectional view of the crossbow shown in FIG. 3 taken along the arrow rest axis that is shown in the un-cocked condition.
Figure 10:
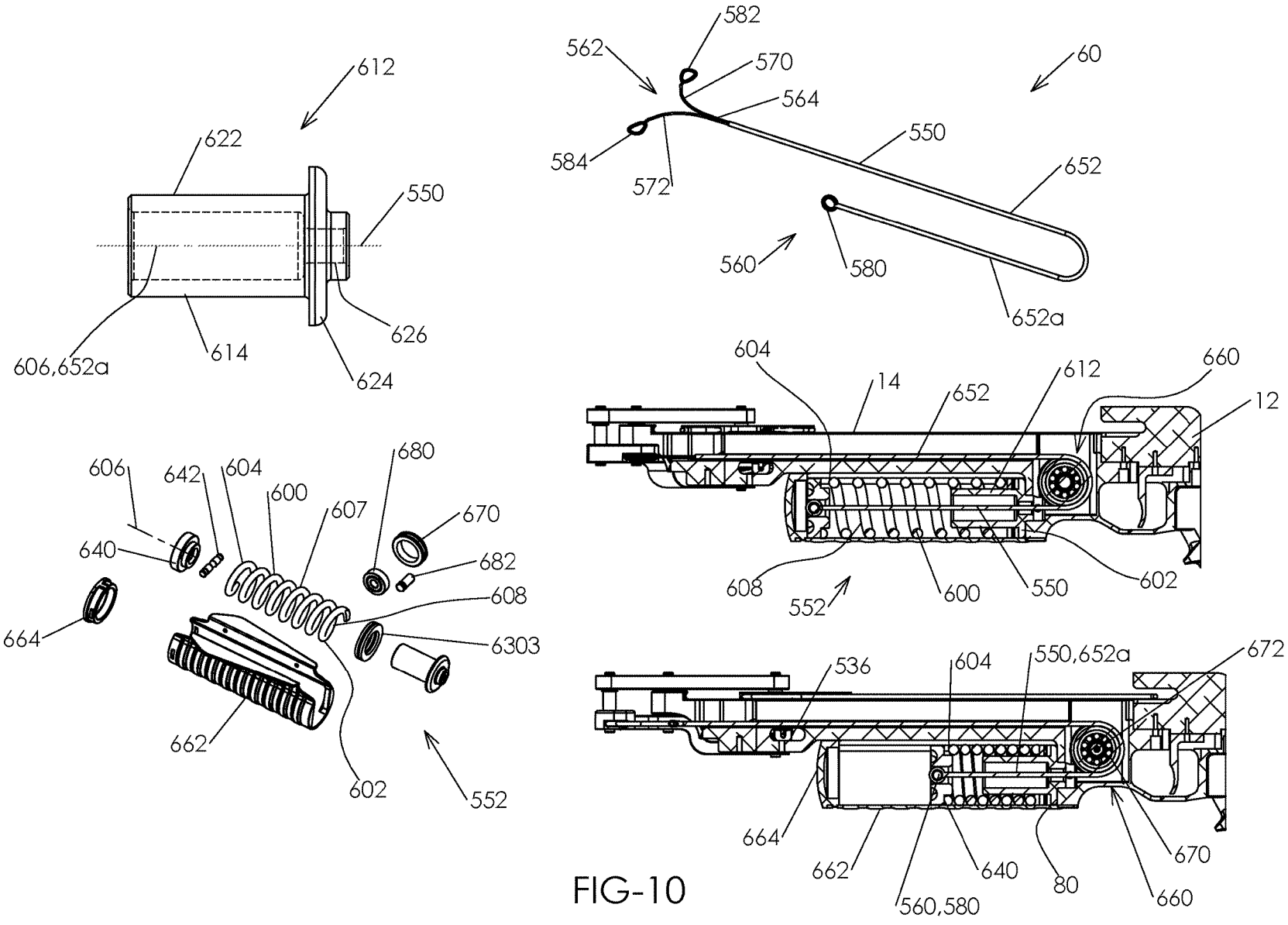
FIG. 10 are multiple views of the power assembly shown in both the un-cocked and the cocked positions.
Figure 11:
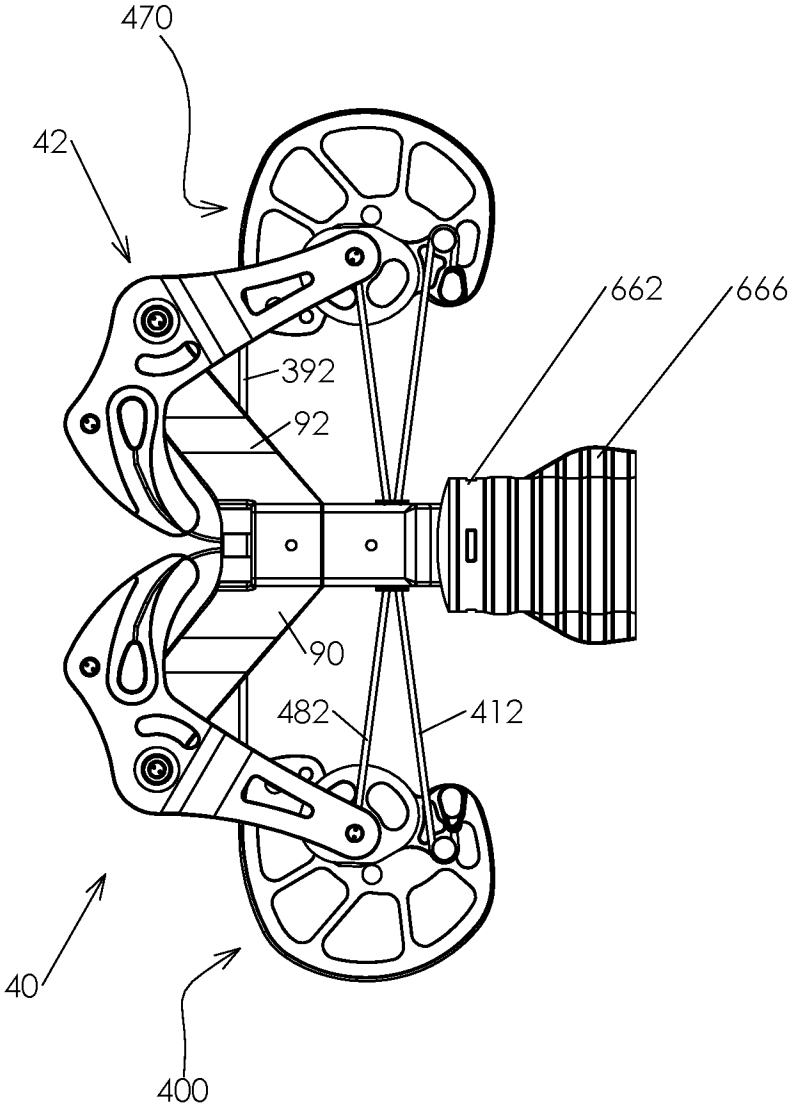
FIG. 11 are enlarged top and bottom views of the forward side of the crossbow shown in FIG. 3 shown in the un-cocked position.
Figure 11:
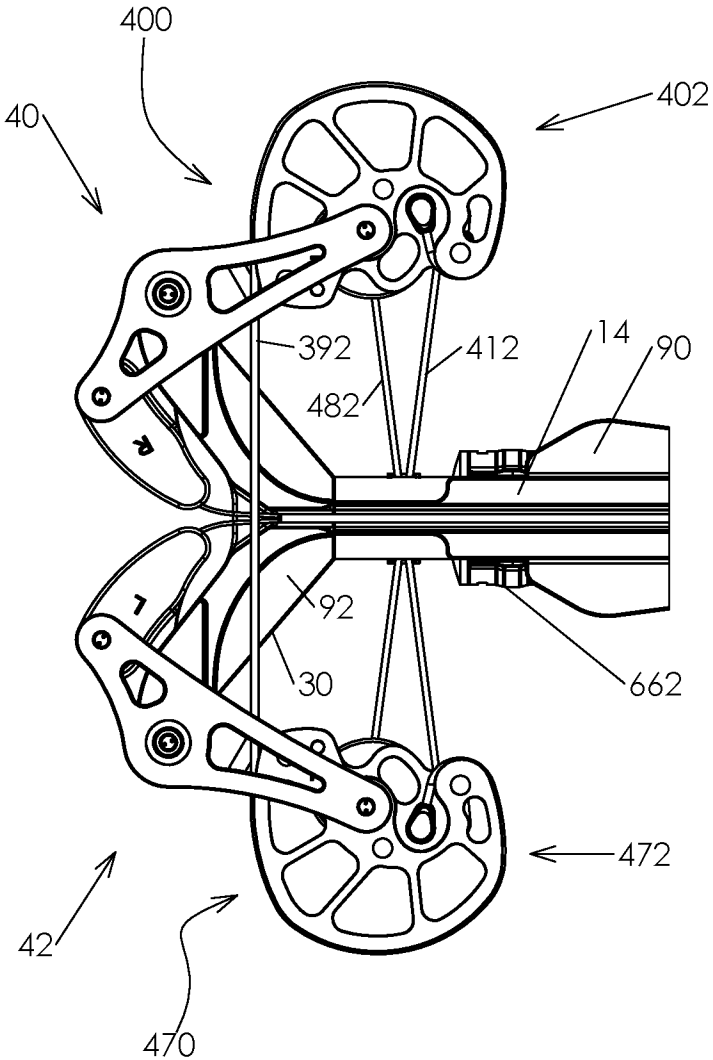
Figure 12:
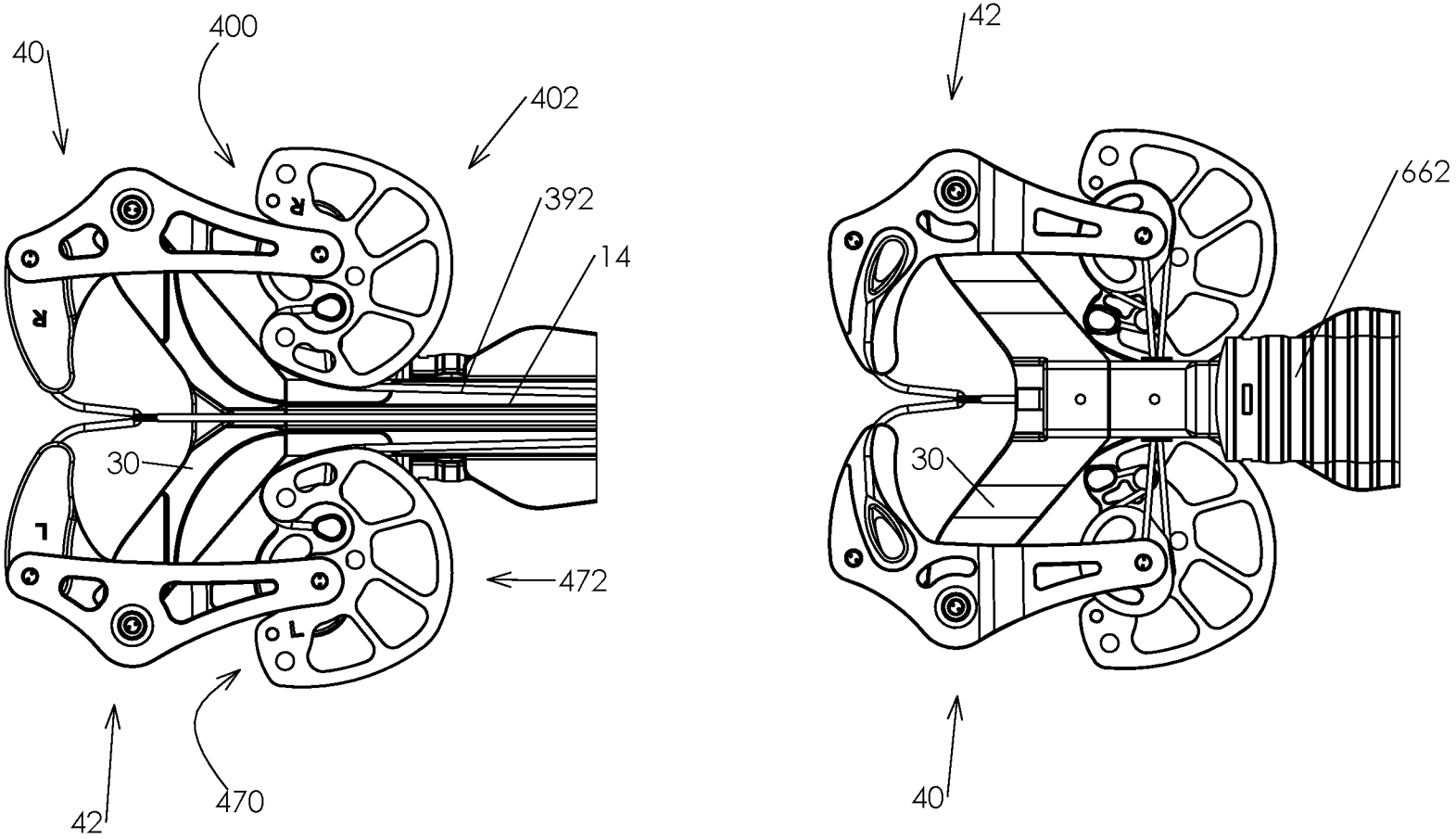
FIG. 12 are enlarged top and bottom views of the forward side of the crossbow shown in FIG. 3 shown in the cocked position.
Figure 13:
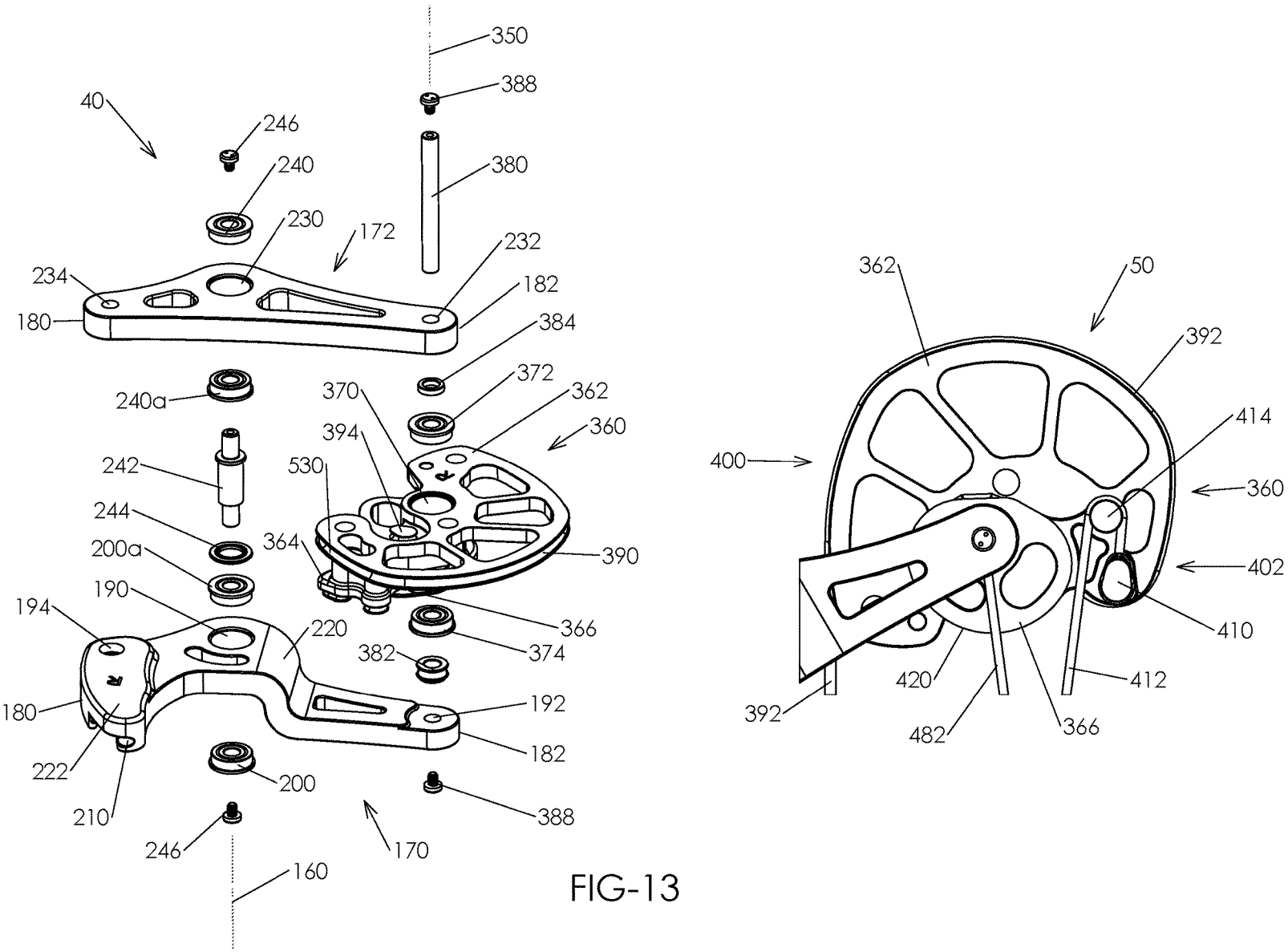
FIG. 13 are enlarged exploded and assembled views of a right limb assembly and a right cam assembly.
Figure 14:
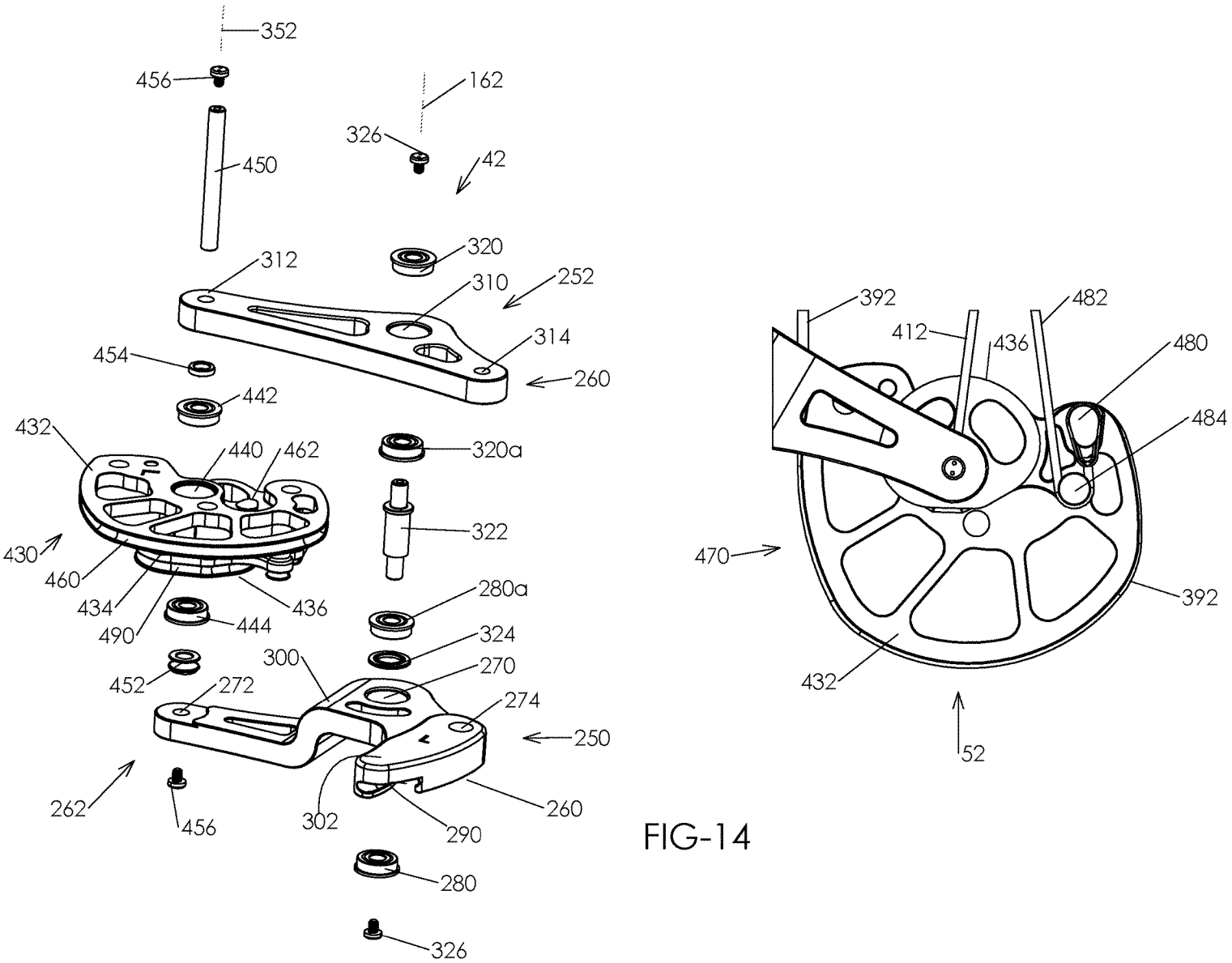
FIG. 14 are enlarged exploded and assembled views of a left limb assembly and a right cam assembly.
Figure 15:
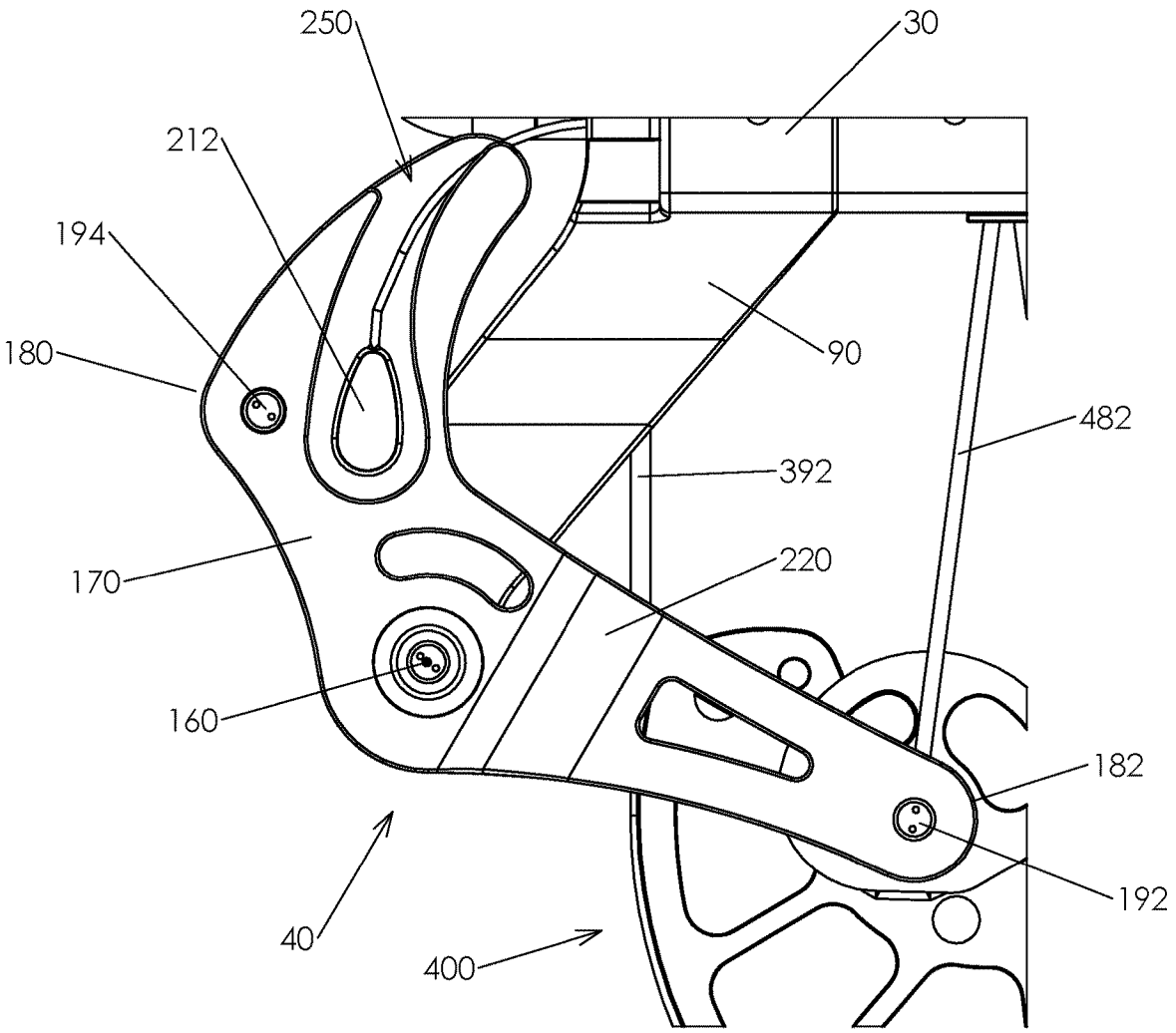
FIG. 15 is an enlarged assembled view of a bottom of the right limb assembly and the right cam assembly.
Figure 16:
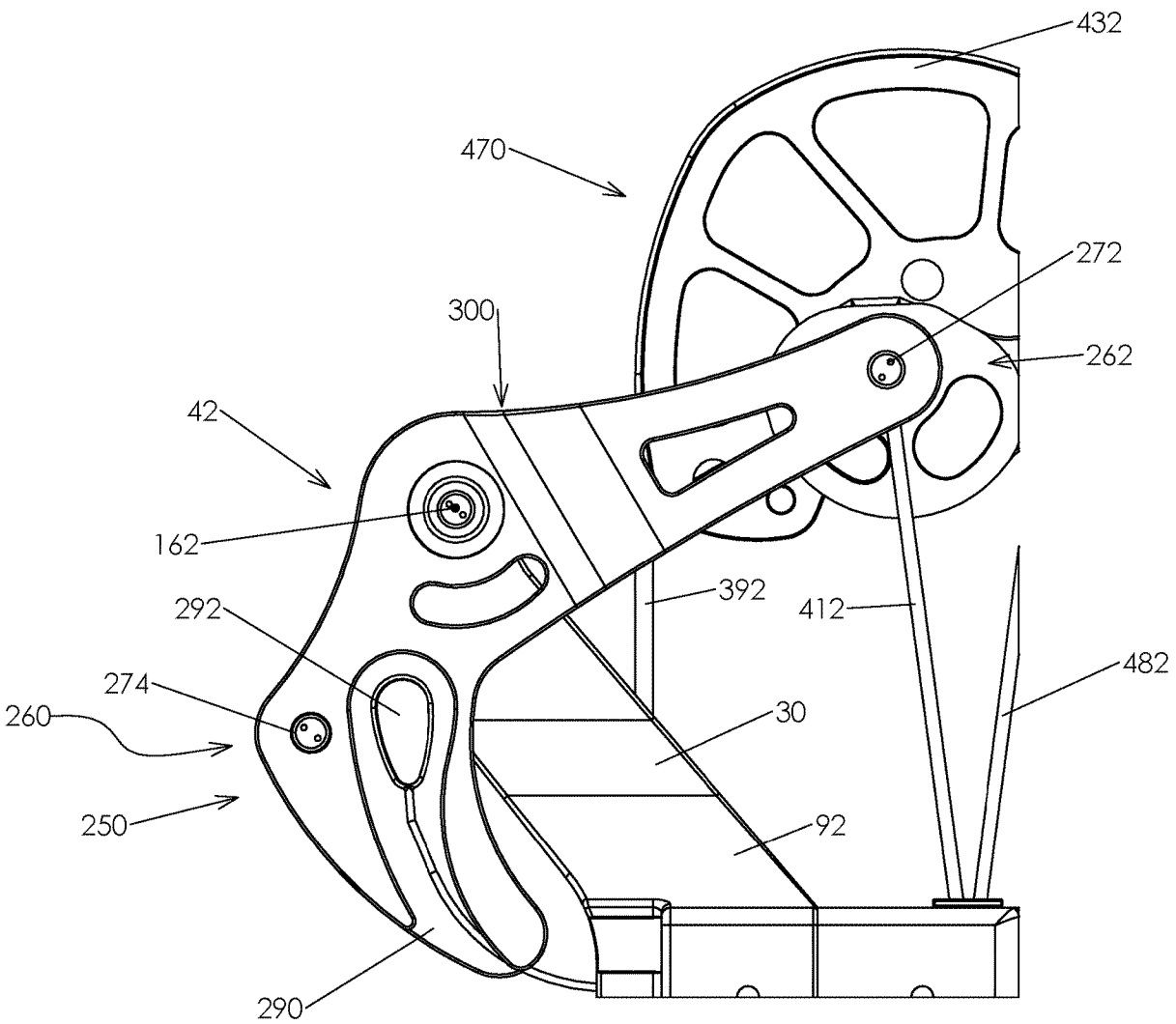
FIG. 16 is an enlarged assembled view of a bottom of the left limb assembly and the right cam assembly.
Figure 17:
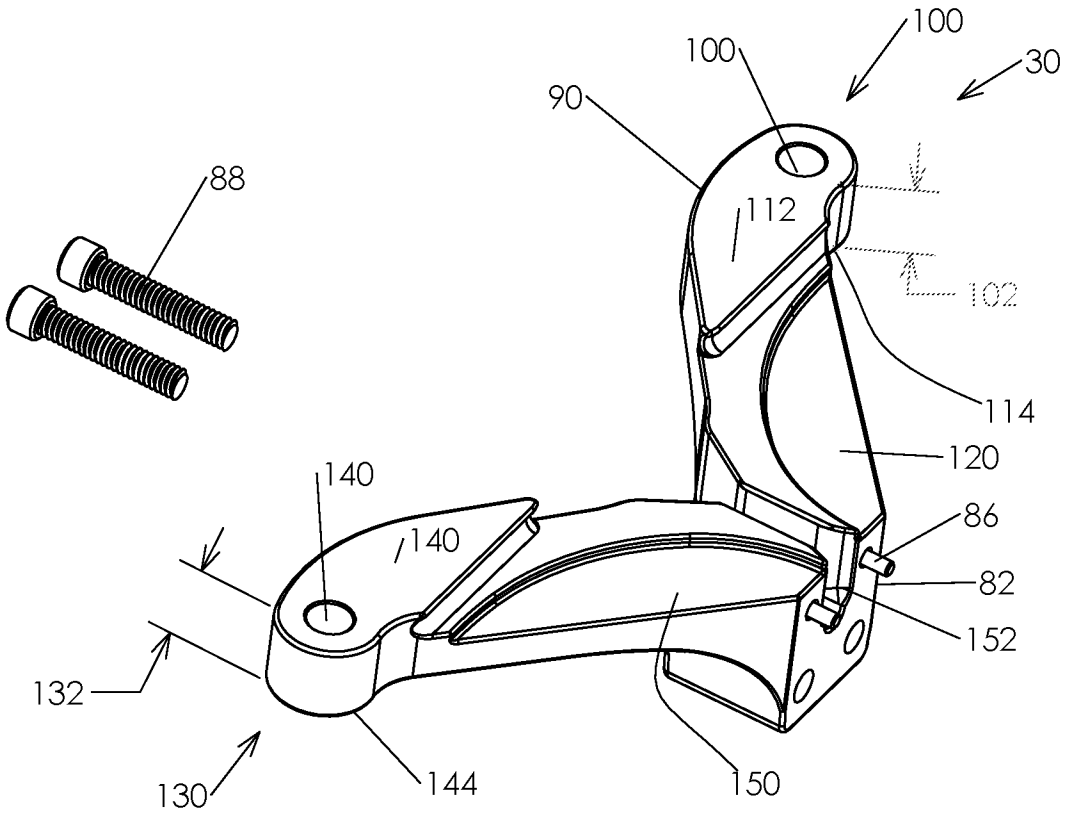
FIG. 17 is a perspective view of a riser of the crossbow shown in the figures.
Figure 18:
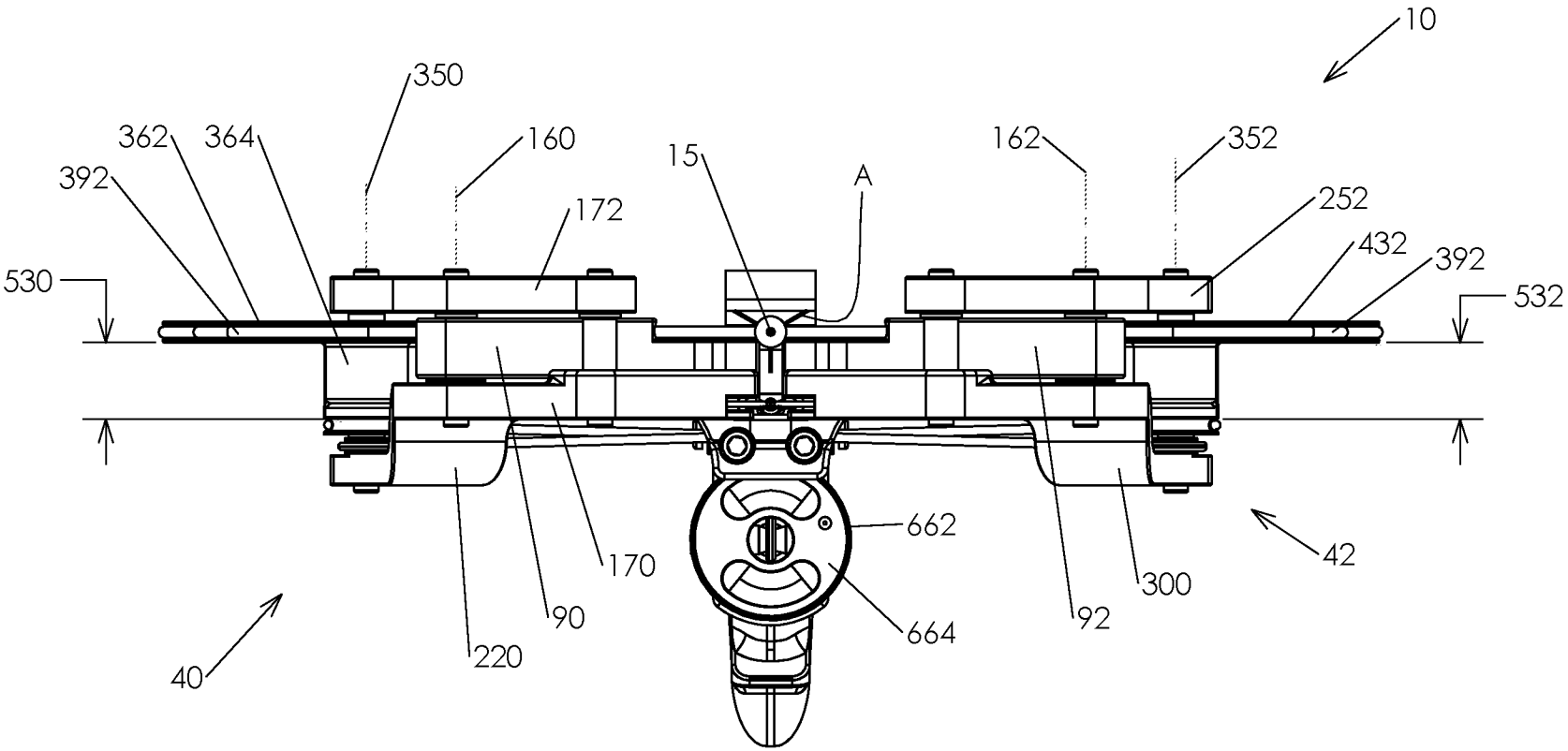
FIG. 18 is a front view of the crossbow shown in FIG. 5 with an arrow positioned on the arrow rest; and, FIG. 19 is a perspective view of the crossbow shown in FIG. 18.
Figure 19:
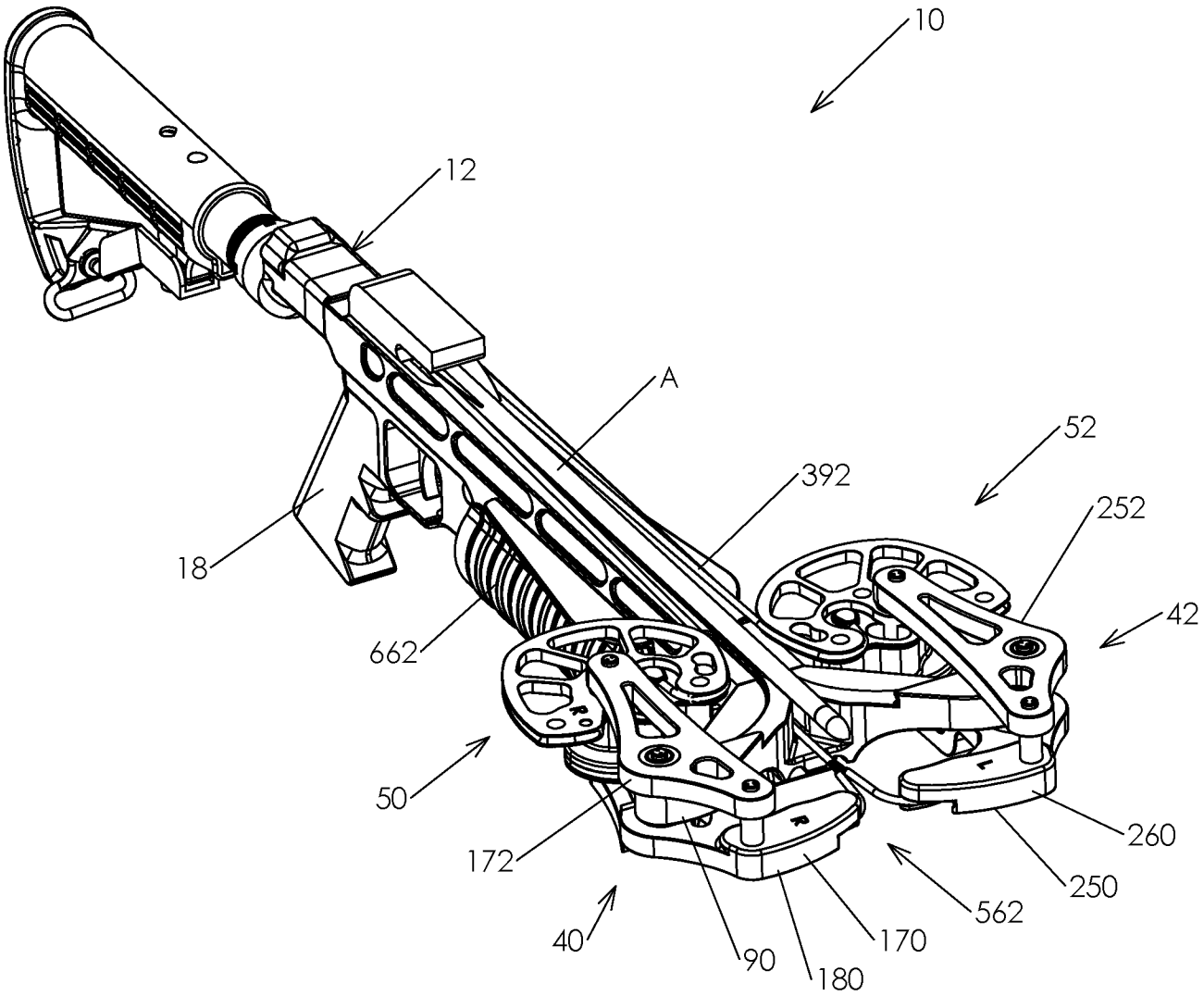

Referring now to the drawings wherein the showings are for the purpose of illustrating preferred and alternative embodiments of the invention only and not for the purpose of limiting the same, FIGS. 1-19 show a crossbow 10 having a crossbow stock 12 and an arrow rest 14 wherein the arrow rest allows an arrow (not shown) to be propelled along an arrow axis 15. Crossbow 10 further includes a trigger assembly 16 and can include a rear grip 18. Moreover, crossbow 10 can include any other feature known in the art or that will be known in the art without detracting from the invention of this application. In that crossbow stocks, arrow rests, trigger assemblies and rear grips are known in the art, these will not be discussed in detail in the interest of brevity. Any types of these components can be used without detracting from the invention of this application.

Crossbow further includes a riser 30, a right limb assembly 40 and a left limb assembly 42 that are pivotably joined to riser 30 and which will be discussed in greater detail below. Rotatably joined to right limb assembly 40 is a right cam assembly 50 and rotatably joined to left limb assembly 42 is a left cam assembly 52, which also will be discussed in greater detail below. Crossbow 10 also includes a power assembly 60 that generates the shooting force to propel an archery arrow which again will be discussed in greater detail below.

In greater detail, crossbow stock 12 and/or a component attached thereto includes a front mounting surface 80 that is shaped to receive riser 30 wherein riser 30 includes a mating mounting surface 82. While riser 30 is shown to be a separate component, this is not required. Riser 30 can be fixed relative to stock 12 with riser pins 86 and/or fasteners 88.

Riser 30 can be V-shaped including a riser right arm 90 and a riser left arm 92. As is shown in the illustrated embodiments, riser 30 can be arcuately shaped, but a wide range of configuration could be utilized without detracting from the invention of this application.

Riser right arm 90 includes a right limb mount 100 having a right limb mount thickness 102. Right limb mount 100 further includes a right limb pivot hole 110 along with an upper right limb mounting surface 112 and a lower right limb mounting surface 114. Riser right arm 90 can include a right clearance relief 120.

Similarly, riser left arm 92 includes a left limb mount 130 having a left limb mount thickness 132. Left limb mount 130 further includes a left limb pivot hole 140 along with an upper left limb mounting surface 142 and a lower left limb mounting surface 144. Riser left arm 92 can include a left clearance relief 150.

Between the left and right riser arms, riser 30 can include a firing cable channel 152. Channel 152 can include a wide range of features that can include, but are not limited to, a continuation of arrow rest 14 and/or arrow channel.

Limbs 40 & 42 of the crossbow are pivotably joined to riser 30 about a limb axes 160 and 162, respectively, that are coaxial with right limb pivot hole 110 and left limb pivot hole 140. While the examples shown and described in this specification show one particular limb configuration, the invention of this application can work with a wide range of limb designs without detracting from the invention of this application. Moreover, while the limbs are described as assemblies, they could be formed from a single component wherein the word assembly is in relation to the features of the limbs and not the construction of the limbs. Even yet further, the use of the word assembly is that the limbs of this application could be formed by multiple components without detracting from the invention of this application.

Again, right limb assembly 40 can have a wide range of configuration without detracting from the invention of this application. This can include, but is not limited to, one piece designs that make up the assembly or a multi-component designs as is shown in the drawings, which has been found to be preferred. In the example shown, assembly 40 includes a right limb base 170 and a right limb top 172. However, it should be noted that while the words like "top" and "bottom" are used in this application, this is in reference to the drawings only wherein is not to be limiting in nature for the disclosed device(s) and/or elements. Top 172 could also be on the bottom side without detracting from the invention. Right limb base 170 extends from a forward end 180 to a rearward end 182. Between the ends, base 170 includes a right limb base pivot hole 190, a right limb lower cam mount 192 and a right forward lower limb mount 194. Right limb base pivot hole 190 can include a right limb lower pivot hole bearing 200. Moreover, lower bearing 200 can include a two bearing arrangement including bearing 200*a*. Right limb base 170 further incudes a right limb cable groove 210 and a right limb cable mount 212. In the embodiments shown, right limb base 170 includes a right base offset 220 and a right base raised portion 222. The right base offset and the right base raised portion can be sized and oriented to allow for the thickness of the riser and the cam, which is shown in the drawings.

Right limb top 172 of the assembly can be a planar component in view of right base offset 220 and right base raised portion 222 of limb base 170. However, as can be appreciated, either component could include the raised portion and/or the offset without detracting from the invention of this application. Right limb top 172 includes a right limb top pivot hole 230, a right limb upper cam mount 232 and a right forward upper limb mount 234. As is shown in the drawings, any and all of the components can include a wide range of features to reduce weight. This can include any means known in the art including but not limited to, use of lightweight materials, shaped designs and weight reducing openings as are shown. Moreover, all of the moving connections between components can utilize bearings to reduce friction and increase service life. In this respect, right limb top pivot hole 230 can include a right limb upper pivot bearing 240. Moreover, upper bearing 240 can include a two bearing arrangement including bearing 240*a*.

Right limb assembly 40 further includes a right limb pivot pin 242 that pivotably joins right limb assembly 40 relative to riser 30. In greater detail, right limb pivot pin 242 extends through right limb top pivot hole 230, right riser limb pivot hole 110 and right limb base pivot hole 190 wherein bearings 200 and 240 can be utilized in this pivotal connection. Right limb assembly 40 can further include one or more washers 244 to further reduce friction and improve the pivoting action of the assembly. Any fastening system can be used to hold the assembly together including, but not limited to, fasteners 246.

Similarly left limb assembly 42 can have a wide range of configuration without detracting from the invention of this application. This can include, but is not limited to, one piece designs that make up the assembly or multi-component designs as is shown in the drawings. In the example shown, assembly 42 includes both a left limb base 250 and a left limb top 252. Left limb base 250 extends from a forward end 260 to a rearward end 262. Between the ends, base 250 includes a left limb base pivot hole 270, a left limb lower cam mount 272 and a left forward lower limb mount 274. Left limb base pivot hole 270 can include a left limb lower pivot hole bearing 280. Left limb base 250 further incudes a left limb cable groove 290 and a left limb cable mount 292. In the embodiments shown, left limb base 250 includes a left base offset 300 and a left base raised portion 302. The left base offset and the left base raised portion can be sized and oriented to all for the thickness of the riser and the cam, which will be discussed more below.

Left limb top 252 can be a planar component in view of left base offset 300 and left base raised portion 302 of limb base 250. However, as can be appreciated, either component could include the raised portion and/or the offset without detracting from the invention of this application. Left limb top 252 includes a left limb top pivot hole 310, a left limb upper cam mount 312 and a left forward upper limb mount 314. As is shown in the drawings, any and all of the components can include a wide range of features to reduce weight. This can include any means known in the art including but not limited to, use of lightweight materials, shaped designs and weight reducing openings as are shown. Moreover, all of the moving connections between components can utilize bearings and/or other friction reducing configurations or devices to reduce friction and increase service life. In this respect, left limb top pivot hole 310 can include a left limb upper pivot bearing 320.

Left limb assembly 42 further includes a left limb pivot pin 322 that pivotably joins left limb assembly 42 relative to riser 30. In greater detail, left limb pivot pin 322 extends through left limb top pivot hole 310, left riser limb pivot hole 140 and left limb base pivot hole 270 wherein bearings 280 and 320 can be utilized in this pivotal connection. Moreover, lower bearing 280 can include a two bearing arrangement including bearing 280*a*. Similarly, bearing 320 can include a two bearing arrangement including bearing 320*a*.

Left limb assembly 42 can further include one or more washers 324 to further reduce friction and improve the pivoting action of the assembly. Any fastening system can be used to hold the assembly together including, but not limited to, fasteners 326.

Cams 50 & 52 of the crossbow are rotatably joined relative to limbs 40 & 42, respectively. Right cam assembly 50 rotates about a right cam axis 350 and left cam assembly rotates about a left cam axis 352. While the examples shown and described in this specification show one particular cam configuration, the invention of this application can work with a wide range of cam designs without detracting from the invention of this application. Moreover, while the cams are described as assemblies, they could be formed from a single component wherein the word assembly is in relation to the features of the cams and not the construction of the cams. Even yet further, the use of the word assembly is that the cams of this application could be formed by multiple components without detracting from the invention of this application.

More particularly, right cam assembly 50, which rotates about right cam axis 350, is formed by a right cam body 360 that again can be formed by one or more components. Cam body 360 includes a right bow string cam disk 362, a right timing cam spacer 364 and a first timing cable cam disk 366. Cam body 360 further includes a right cam pivot hole 370, a right upper cam bearing 372 and a right lower cam bearing 374 wherein right cam assembly 50 is rotatably joined relative to right limb 40 about right cam axis 350. A right cam pin or axle 380 can be used for the rotational connection. The rotational connection can further include spacers 382 and/or washers 386 to further reduce friction, improve the pivoting action of the assembly and/or to better align the cam relative to the limb. Any fastening system can be used to hold the assembly together including, but not limited to, fasteners 388.

Any pin or axle design could be used without detracting from the invention of this application for this cam and/or any movable component of the invention of this application.

Right bow string cam disk 362 includes a right bow string groove 390 that is configured to have a pulley-like configuration shaped to receive a bow string 392. Cam body 360 further includes a right bow string mount 394. The shape and/or configuration of right bow string cam disk 362 and right bow string mount 394 can be any that are known in the industry or to be known in the future wherein further descriptions of these are not being provided in the interest of brevity. Right bow string cam disk 362 further includes a forward extent 400 and a rearward extent 402 that are in relation to the overall orientation of the crossbow during use. As can be appreciated, the specific circumferential location of these extents about the right bow string groove changes as the disk rotates. In the embodiment shown, bow string 392 generally exits the right bow string groove about the front extent of the disk.

Cam body 360 further includes a first timing cable mount 410 to secure a first timing cable 412 and can include a first timing cable guide 414. First timing cable cam disk 366 includes a first timing cable groove 420 that is configured to have a pulley-like configuration shaped to receive first timing cable 412.

Left cam assembly 52, which rotates about left cam axis 352, is formed by a left cam body 430 that again can be formed by one or more components. Cam body 430 includes a left bow string cam disk 432, a left timing cam spacer 434 and a second timing cable cam disk 436. Cam body 430 further includes a left cam pivot hole 440, a left upper cam bearing 442 and a left lower cam bearing 444 wherein left cam assembly 52 is rotatably joined relative to left limb 42 about left cam axis 352. A left cam pin or axle 450 can be used for the rotational connection. Any pin or axle design could be used without detracting from the invention of this application. Moreover, the rotational connection can further include spacers 452 and/or washers 454 to further reduce friction, improve the pivoting action of the assembly and/or to better align the cam relative to the limb. Any fastening system can be used to hold the assembly together including, but not limited to, fasteners 456.

Left bow string cam disk 432 includes a left bow string groove 460 that is configured to have a pulley-like configuration shaped to receive an opposite end of bow string 392 as right bow string cam disk 362. Left cam body 430 further includes a left bow string mount 462. The shape and/or configuration of left bow string cam disk 432 and left bow string mount 462 can be any that are known in the industry or to be known in the future wherein further descriptions of these are not being provided in the interest of brevity. Left bow string cam disk 432 further includes a forward extent 470 and a rearward extent 472 that are in relation to the overall orientation of the crossbow during use. As can be appreciated, the specific circumferential location of these extents about the left bow string groove change as the disk rotates. In the embodiment shown, bow string 392 generally exits the left bow string groove about the front extent of the disk.

Cam body 360 further includes a second timing cable mount 480 to secure a second timing cable 482 and can include a second timing cable guide 484. Second timing cable cam disk 436 includes a second timing cable groove 490 that is configured to have a pulley-like configuration shaped to receive second timing cable 482.

Bow string 392 extends between a bow string right extent 500 and a bow string left extent 502. Right extent 500 can include a right bow string loop 504 that interengages with right bow string mount 394. Left extent 502 can include a left bow string loop 506 that interengages with left bow string mount 462.

First timing cable 412 extends between a first timing cable right extent 510 and a first timing cable left extent 512. Right extent 510 can include a right first timing loop 514 that interengages with first timing cable mount 410 of right cam 40. Left extent 512 can include a left first timing loop 516 that extends about left cam pin or axle 450 of left cam 42. Similarly, second timing cable 482 extends between a second timing cable right extent 520 and a second timing cable left extent 522. Left extent 522 can include a left second timing loop 524 that interengages with second timing cable mount 480 of left cam 42. Right extent 520 can include a right second timing loop 526 that extends about right cam pin or axle 380 of right cam 40.

Moreover, right timing cam spacer 364 can have a spacer right spacer thickness 530 and left timing cam spacer thickness 532 to ideally align timing cables 412 and 482 relative to the crossbow stock and arrow track to allow them to pass by the fore stock of the crossbow without any adverse engagement with the stock. In one set of embodiments, right and left spacer thicknesses 530 and 532 are greater than 0.25 inches. In another set of embodiments, right and left spacer thicknesses 530 and 532 are greater than 0.35 inches. In yet another set of embodiments, right and left spacer thicknesses 530 and 532 are greater than 0.40 inches. In even yet another set of embodiments, right and left spacer thicknesses 530 and 532 are greater than 0.50 inches. Moreover, the timing cable spacers can align the timing cables with an opening 536 in the crossbow stock 12 that is below arrow rest 14. By spacing the timing cable from the bow string and aligning them with an opening in the crossbow stock, the timing cables can freely move without creating adverse resistance or wear points with other components of the crossbow. Moreover, by reducing the timing cable spacing and using pass through opening 536, the spacing between the bow string disks and the timing cable disk can be minimize to minimize any moment produced between the differently directed forces in the bow string and the timing cables.

Power assembly includes a power cable 550, a spring assembly 552 and can include a pulley system to allow for the ideal placement of the spring assembly within the crossbow.

Power cable 550 extends from a rear end 560 to a forward end 562. As is shown, cable 550 includes a power cable splitter 564 between the ends that can be configured to split the forward end into a right power cable extension 570 and a left power cable extension 572. As is shown, splitter 564 is closer to forward end 562. In particular, splitter can be near riser 30. In one set of embodiments, splitter is at or near cable channel 152. Rear end 560 can include a rear end loop or spring side loop 580. Right power cable extension 570 can include a right extension loop 582 and a left power cable extension 572 can include a left extension loop 584. Right extension loop 582 is configured to interengage with right limb cable mount 212 of right limb assembly 40. As is shown in the example embodiment, right limb cable mount 212 is a part of right limb base 170. Moreover, right limb base 170 can include one or more right limb cable grooves 210 that can be arcuate to reduce stresses in right extension 570 during the power stroke of the crossbow. Similarly, left extension loop 584 is configured to interengage with left limb cable mount 292 of left limb assembly 42. As is shown in the example embodiment, left limb cable mount 292 is a part of left limb base 250. Moreover, left limb base 250 can also include one or more left limb cable grooves 290 that can be arcuate to reduce stresses in left extension 572 during the power stroke of the crossbow.

Spring assembly 552 can have a wide range of configurations without detracting from the invention of this application. In its preferred configuration, spring assembly 552 includes a power spring 600 wherein rear end 560 of power cable 550 pulls on the power spring. Power spring 600 extends between a first spring end 602 and a second spring end 604 along a spring axis 606. Power spring 600 further includes coils 607 extending about a central spring opening 608.

Power spring 600 can be a wide range of springs without detracting from the invention of this application. In a preferred set of embodiments, power spring 600 can be High Tensile Silicon Chrome spring, which produces the needed spring force while being lightweight and durable. Accordingly, power spring 600 can have a mass weight of spring of only about 0.55 pounds. Power spring can have a free length of about 6 inches between ends 602 and 604. The spring can have a solid height of about 2.97 inches with a total deflection of about 3.026 inches. Moreover, power spring 600 can have an outside diameter of about 1.7 inches with an inside diameter of about 1.134 inches. The spring rate (lbs/in) of power spring 600 can be 350 lbs/in. The max load at solid can be around 1,059.1 lbs. In the embodiment shown, power spring 600 can have about 9.259 active coils with a wire diameter of about 0.283 inches.

In the embodiment shown, crossbow stock or receiver 12 includes a spring mounting face or surface 610 and spring assembly 552 can engage with spring mounting face or surface 610. Spring assembly can further include a spring stabilizer 612 that can be configured to engage and/or interengage with face or surface 610 to maintain and operable alignment between spring 600 and the crossbow. Spring stabilizer can be positioned between mounting face 610 and first spring end 602. In the embodiment shown, stabilizer 612 includes a stabilizer sleeve 614 having a spring facing surface 622 that can help maintain a desired orientation of power spring 600. Sleeve 614 can be an inner sleeve wherein spring facing surface 622 is an outer surface of the sleeve. Stabilizer can further include a stabilizer flange 624 and a power cable opening 626. Spring assembly 552 and/or stabilizer 612 can further include a stabilizer washer 630 configured to engage first spring end 602 and a stabilizer projection 628.

Spring assembly 552 can further include a spring mounting cap or washer 640 configured to engage second spring end 604 and a cable mount pin 642 wherein rear end loop or spring side loop 580 is mounted about cable mount pin 642 such that when the power cable is pulled, second spring end 604 is pulled toward first spring end 602 thereby compressing spring 600 to produce the shooting force to propel the archery arrow. Stabilizer mounting surface 610 can further include a stabilizer mounting opening 650 that is shaped to receive a stabilizer projection 628 to further stabilize the spring and keep it in a desired orientation.

Again, and according to yet further aspects of the invention, the firing system can include one or more re-directing pullies to change the direction of the force produced by the power cable. These re-directing pullies can include a lowering pulley arrangement to re-direct the power cable lower within the crossbow receiver thereby allowing spring 600 to be both below the arrow rest 14 and wherein spring axis 606 is parallel to and below arrow axis 15. In greater detail, power cable 550 extends along a power cable axis 652 and the one or more re-directing pullies can change the power cable axis. This can include, but is not limited to, a two-pulley lowering pulley arrangement (not shown) to lower power cable axis 652 to axis 652*a* wherein axis 652*a* is parallel to axis 652 and spaced further below bolt track or arrow rest 14, but the cable moves in the same general direction before and after the pulley. As can be appreciated, stacking the arrow rest and spring assembly can reduce size, reduce weight and produce a better center of gravity. Moreover, these spring arrangements of the firing system can be configured to have a spring axis that is parallel with the arrow rest axis. By having a parallel spring assembly, shooting forces align with the direction of the arrow as it is released.

As is shown in the illustrated embodiments, the re-directing pullies can include a reversing pulley assembly 660 that re-directs the power cable 180 degrees to allow the power cable to pull power spring 600 rearwardly. In greater detail, power cable extends from the limbs along power cable axis 652. Reversing pulley assembly 660 both re-directs the power cable 180 degrees and lowers the power cable axis to power cable axis 652*a* that is further from and parallel to arrow axis 15, but that is moving in a generally opposite direction after the pulley. Power cable 550 enters central spring opening 608 at first spring end 602 and extends along power cable axis 652*a* that is generally parallel to and/or coaxial with spring axis 606 and extends toward second spring end 604 wherein rear end loop 580 allows rear end 560 of power cable 550 to engage second spring end 604. Accordingly, the pulling of power cable 550 causes the power cable to pull second spring end 604 rearwardly toward first spring end 602 thereby compressing spring 600. This arrangement has been found to move the center of gravity even further rearwardly when the cross bow is in the full draw or cocked condition. Moreover, the firing system can include a sleeve arrangement (not shown) that can engage an end of the spring and encircle the spring. In certain embodiments, this spring 600 can be housed within a fore grip 662 of the cross bow. Fore grip 662 can include a fore grip cap 664 to such that the fore grip fully encapsulate spring assembly 552. Fore grip 662 can further include guard flanges 666 that can protect the user's hand from the shooting action of the arrow being released from arrow rest 14. Fore grip 662 can also include a mounting arrangement that can include any mounting configuration including, but not limited to, mounting face 668 and one or more fastener openings 669. Moreover, fore grip 662 can have any features known in the art. Reversing pulley assembly 660 can include a power cable pulley 670 that rotates around a pulley axis 672 wherein pulley axis 672 is a horizontal axis transverse to and below arrow track axis 15. Pulley assembly can include a pulley bearing 680 and can rotate about a pulley pin 682. As is shown, pulley 670 is behind spring 600 wherein power cable pulls power spring 600 rearwardly thereby moving the weight of the spring rearwardly as it moves to the cocked condition. Moreover, spring axis 606 is both parallel to and below arrow track axis 15. In particular, second spring end 604 is the forward end of spring 600 and first spring end 602 is the rearward end of the spring. While not shown, reversing pulley assembly 660 can re-direct the power cable in other directions without detracting from the invention of this application. While re-directing the power cable is shown to be 180 degrees in the disclosed example to allow the power cable to pull power spring 600 rearwardly, it could also be at other angles. In one set of embodiments, the re-direction angle could be 90 degrees to allow the power cable to pull the power spring upwardly. In this embodiment, the foregrip could be a vertically extending foregrip. In one set of embodiments, the pulley system is to allow the power spring to be positioned below the plane of the arrow axis, the plane of the arrow rest, the plane of the limbs, the plane of the timing cable disks and/or the plane of the bow string discs.

As is best shown in FIGS. 2, 4, 6, 8, and 10-12, crossbow 10 is shown in an un-cocked condition. As is best shown in FIGS. 5, 7, 9, 10-12 and 19, crossbow 10 is shown in a cocked or full draw condition. Moving the crossbow from the un-cocked condition to the cocked condition, which can include pulling bow string 392 rearwardly along arrow rest 14, when looking from the top of the crossbow, urges cam assemblies 50 and 52 toward one another. Since bow string 392 exits around the front sides of the cams, right cam assembly 50 rotates counterclockwise about right cam axis 350 as it moves toward arrow track 14 and left cam assembly rotates clockwise about left cam axis 352 as it moves toward arrow track 14. The movement of the cam assemblies toward one another, rotates right limb assembly 40 clockwise about right limb axis 160 and rotates left limb assembly 42 counter clockwise about left limb axis 162. Moreover, right and left cam assemblies 50 and 52 move toward arrow rest 14 rearwardly of limb axes 160 and 162 since right cam axis 350 and left cam axis 352 are behind right limb axis 160 and left limb axis 162, respectively.

The movement of right limb assembly 40 clockwise about right limb axis 160 and the movement of left limb assembly 42 counter clockwise about left limb axis 162 in turn pulls on power cable 550. As power cable 550 is pulled by the limbs, this causes a pulling of second spring end 604 toward first spring end 602 thereby compressing spring 600 to produce the shooting force to propel the archery arrow.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A firing system for a crossbow; the crossbow having an arrow rest extending along an arrow rest axis, the firing system comprising a right limb and a left limb, the right limb being pivotable about a right limb axis relative to the arrow rest and the left limb being pivotable about a left limb axis relative to the arrow rest, the right limb and the left limb being positionable between an un-cocked condition and a cocked or full draw condition wherein movement from the un-cocked condition toward the cocked condition pivots the right and left limbs about the right and left limbs axes respectively, the firing system further comprising a power assembly having a power cable with a right extension and a left extension, the firing system further having a spring assembly, the power cable having a forward end including the right and left extensions wherein the right extension is operably joined to the right limb and the left extension is operably joined to the left limb, and the power cable further including a rear end operably joined to the spring assembly, the spring assembly having a power spring extending along a power spring axis between a first spring end and a second spring end and having a central spring opening, the power spring being parallel to the arrow rest axis, the power cable extending through the central spring opening from the first spring end toward the second spring end, the rear end of the power cable being operably joined relative to the second spring end of the power spring, moving the right limb and the left limb from the un-cocked condition to the cocked condition pulling the forward end of the power cable forwardly wherein the operable engagement with the second spring end compressing the power spring by pulling the second spring end toward the first spring end to produce the shooting force to propel the archery arrow.

2. The firing system of claim 1, wherein the power cable extends along a power cable axis and the firing system further including at least one re-directing pulley for the power cable, the power cable axis being below the arrow rest and the at least one re-directing pulley further spacing the power cable axis from the arrow rest axis and aligning the spring axis to be parallel with the arrow rest.

3. The firing system of claim 2, wherein the at least one re-directing pulley for the power cable includes a 180 degree pulley such that the power cable extends along a first power cable axis and in a first direction before the 180 degree pulley and extends along a second power cable axis and in a second direction after the 180 degree pulley, the first power cable axis being generally parallel to the second power cable axis and the first direction being generally opposite of the second direction.

4. The firing system of claim 3, wherein the first spring end is rearwardly of the second spring end and the power spring is compressed rearwardly.

5. The firing system of claim 4, wherein the first power cable axis is between the second power cable axis and the arrow rest axis.

6. The firing system of claim 1, wherein the power cable extends along a power cable axis and the firing system further including at least one re-directing pulley for the power cable, the at least one re-directing pulley for the power cable including a 180 degree pulley such that the power cable extends along a first power cable axis and in a first direction before the 180 degree pulley and extends along a second power cable axis and in a second direction after the 180 degree pulley, the first power cable axis being generally parallel to the second power cable axis and the first direction being generally opposite of the second direction.

7. The firing system of claim 1, wherein the power cable includes a splitter wherein the right power cable extension and the left power cable extension are joined together to form a single power cable rearwardly of the splitter.

8. The firing system of claim 1, the firing system further including a riser having a riser right arm and a riser left arm, the riser further being fixed relative to the arrow rest and having a firing cable channel between the riser right arm and the riser left arm.

9. The firing system of claim 1, wherein the firing system further includes a riser having a riser right arm and a riser left arm, the riser being fixed relative to the arrow rest, the right limb being pivotably joint to the riser right arm about the right limb axis and the limb being pivotably joined to the riser left arm about the left limb axis.

10. The firing system of claim 9, wherein the riser has a V-shape configuration and having a firing cable channel between the riser right arm and the riser left arm, a portion of the power cable extending through the firing cable channel.

11. The firing system of claim 9, wherein the right limb includes a right limb base and a right limb top fixed relative to the right limb base forming a unified right limb assembly, the left limb includes a left limb base and a left limb top fixed relative to the left limb base forming a unified left limb assembly.

12. The firing system of claim 11, wherein the right limb base is below the riser right arm and the right limb top is above the riser right arm, the left limb base being below the riser left arm and the left limb top being above the riser left arm.

13. The firing system of claim 1, further including a right cam and a left cam, the right cam having a right bow string groove and being rotatable about a right cam axis, the left cam having a left bow string groove and being rotatable about a left cam axis, the right limb extending from a right limb forward end to a right limb rearward end, the right limb having a right limb cable mount on a forward side of the right limb axis wherein the right power cable extension is operably joined to the right limb cable mount, the right cam axis being on a rearward side of the right limb axis, the left limb extending from a left limb forward end to a left limb rearward end, the left limb having a left limb cable mount on a forward side of the left limb axis wherein the left power cable extension is operably joined to the left limb cable mount, the left cam axis being on a rearward side of the left limb axis.

14. The firing system of claim 1, wherein the right limb is L-shaped and the left limb is L-shape.

15. The firing system of claim 1, further including a spring stabilizer, the crossbow including a spring mounting face or surface and the spring stabilizer being position between mounting face and first spring end.

16. The firing system of claim 15, wherein the spring stabilizer has a stabilizer sleeve with a spring facing surface coaxial with the spring axis, the stabilizer sleeve being an inner stabilizer sleeve and the spring facing surface is an outwardly facing surface.

* * * * *